US008003287B2

(12) United States Patent
Obata et al.

(10) Patent No.: US 8,003,287 B2
(45) Date of Patent: Aug. 23, 2011

(54) ELECTROPHOTOGRAPHIC PHOTOCONDUCTOR AND IMAGE-FORMING APPARATUS

(75) Inventors: Takatsugu Obata, Nara (JP); Akihiro Kondoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 770 days.

(21) Appl. No.: 12/000,720

(22) Filed: Dec. 17, 2007

(65) Prior Publication Data

US 2008/0166642 A1 Jul. 10, 2008

(30) Foreign Application Priority Data

Dec. 29, 2006 (JP) ..... 2006-356818

(51) Int. Cl.
*G03G 5/047* (2006.01)

(52) U.S. Cl. ..... 430/58.8; 430/58.85; 430/72; 430/73

(58) Field of Classification Search ..... 430/58.85, 430/58.75, 72, 73, 58.8; 399/159
See application file for complete search history.

(56) References Cited

U.S. PATENT DOCUMENTS 4,123,269 A 10/1978 Von Hoene et al.
6,270,936 B1 * 8/2001 Tanaka et al. ..... 430/59.5

FOREIGN PATENT DOCUMENTS

| | | |
|---|---|---|
| JP | 58-32372 | 7/1983 |
| JP | 58-198043 | 11/1983 |
| JP | 61-189547 | 8/1986 |
| JP | 02-051162 | 2/1990 |
| JP | 02-190862 | 7/1990 |
| JP | 05-066587 | 3/1993 |
| JP | 06-348045 | 12/1994 |
| JP | 10-301308 | 11/1998 |
| JP | 2000-143654 | 5/2000 |
| JP | 2000-235272 | 8/2000 |
| JP | 2005-189797 A | 7/2005 |

OTHER PUBLICATIONS

Japanese Patent Office machine-assisted translation of JP 2005-189797 (pub. Jul. 2005).*

* cited by examiner

*Primary Examiner* — Janis L Dote
(74) *Attorney, Agent, or Firm* — Nixon & Vanderhye P.C.

(57) ABSTRACT

The present invention provides an electrophotographic photoconductor comprising an electroconductive substrate and a photosensitive layer provided on the electroconductive substrate, wherein the photosensitive layer comprises a charge-generating material and a charge-transporting material, the charge-transporting material comprising a compound represented by the general formula (1):

(1)

wherein $Ar^1$ and $Ar^2$ each independently represent an optionally-substituted arylene or bivalent heterocyclic group; $Ar^3$ and $Ar^4$ each independently represent a hydrogen atom, or an optionally-substituted aryl or monovalent heterocyclic group, but are not simultaneously hydrogen atoms; or $Ar^3$ and $Ar^4$ may be taken together to form an optionally-substituted bivalent cyclic hydrocarbon or heterocyclic group; and n is 0 or 1.

12 Claims, 3 Drawing Sheets

ELECTROPHOTOGRAPHIC PHOTOCONDUCTOR AND IMAGE-FORMING APPARATUS

CROSS-REFERENCE TO RELATED APPLICATION

This application is related to Japanese Patent Application No. 2006-356818 filed on Dec. 29, 2006, whose priority is claimed under 35 USC §119, the disclosure of which is incorporated herein in its entirety by reference for any and all purposes.

BACKGROUND OF THE INVENTION

1. Field of the Invention

The present invention relates to an electrophotographic photoconductor which comprises an organic compound with high charge transportability as a charge-transporting material, and to an image-forming apparatus comprising the same.

2. Description of the Related Art

Recently, organic photoconductive materials have been widely researched and developed. They have been used for electrophotographic photoconductors (also referred to simply as "photoconductors"), and are now beginning to be applied to electrostatic recording devices, sensor materials, organic electroluminescent (EL) devices, etc.

Organic photoconductors, in which organic photoconductive materials are used, are utilized not only in the field of copiers, but also in the fields of printing plates, slide film and microfilm, for which conventional photographic technology has been employed. Further, they are applied to high-speed printers with the use of a laser, a light emitting diode (LED), a cathode ray tube (CRT) or the like as a light source.

Thus, there is a high level and wide range of demands on organic photoconductive materials and organic photoconductors.

Conventionally, as an electrophotographic photoconductor, an inorganic photoconductor has been widely used, which contains, as its active material, an inorganic photoconductive material such as selenium, zinc oxide or cadmium.

Although having basic properties for an electrophotographic photoconductor to some degree, an inorganic photoconductor has problems of difficulties in forming its photosensitive layer, poor plasticity of the layer, high production costs, and the like. In addition, generally inorganic photoconductive materials are so toxic that they are limited in terms of production and handling.

In contrast, organic photoconductors have various advantages of the photosensitive layer being easy to form, flexible, lightweight, and highly transparent. They also can be readily designed to have good sensitivity to a wide range of wavelengths by appropriate sensitization. Accordingly, in recent years, electrophotographic photoconductors have been developed mainly as organic photoconductors.

Although early organic photoconductors had some drawbacks in sensitivity and durability, these drawbacks have been significantly overcome by function-separated photoconductors in which the charge generation and transport functions are respectively served by different materials.

Such function-separated photoconductors have advantages to be relatively easily produced to have any desired properties since a charge-generating material responsible for the charge generation function and a charge-transporting material responsible for the charge transport function each can be selected from a wide range of materials.

As a charge-generating material used in a function-separated photoconductor, many materials have been examined, such as phthalocyanine pigments, squarylium dyes, azo pigments, perylene pigments, polycyclic quinone pigments, cyanine dyes, squaric acid dyes and pyrylium salt dyes, and various materials have been proposed that exhibit high light resistance and high charge-generating ability.

As a charge transporting material, a variety of compounds are known, such as pyrazoline compounds (see, for example, Japanese Patent Publication No. Sho 61 (1986)-189547-A), hydrazone compounds (see, for example, Japanese Patent Publication No. 2000-143654-A), triphenylamine compounds (see, for example, Japanese Patent Publication No. Sho 58 (1983)-32372-B), stilbene compounds (see, for example, Japanese Patent Publication Nos. Sho 58 (1983)-198043-A and Hei 2 (1990)-190862-A) and enamine compounds (see, for example, Japanese Patent Publication No. Hei 2 (1990)-51162-A).

Charge-transporting materials are required: (1) to be stable to light and heat; (2) to be stable to ozone, nitrogen oxides ($NO_x$), nitric acid and the like generated by a corona for charging a photoconductor surface; (3) to have high charge-transportability; (4) to be highly compatible with an organic solvent and a binder resin; and (5) to be easy to produce, and inexpensive. Conventional charge-transporting materials as described above meet some, but not all, of the requirements at a high level.

Of the above requirements, (3) "to have high charge-transportability" is the most important. This is because the charge-transportability of a charge transporting material used for a photoconductor needs to be sufficiently high to ensure a high photoresponsiveness of the photoconductor's surface layer formed by dispersing the material with a binder resin.

When a photoconductor is used in a copier, a laser beam printer or the like, the photoconductor's surface layer is scraped off by one or more contact members such as a cleaning blade and a charging roller. In order to increase the durability of copiers, laser beam printers or the like, therefore, it is necessary that the surface layer is hard to be scraped off by such a contact member, i.e., it has high printing durability.

If the content of the binder resin in the charge transport layer as a surface layer is increased so as to make the layer more durable, the photoresponsiveness of the layer decreases. This is because conventional charge-transporting materials have low charge-transportability and therefore the charge-transportability of the charge-transport layer further decreases when the charge-transporting material content decreases as a result of the increase of the binder resin content.

If the photoresponsiveness of a photoconductor is poor, its residual surface potential increases and therefore the photoconductor is repeatedly used without sufficiently attenuating the surface potential. In the photoconductor, the surface charge in the area exposed to light is not sufficiently erased, resulting in a rapid deterioration in image quality. This is a reason why charge transporting materials for photoconductors are required to have high charge-transportability sufficient to ensure high photoresponsiveness.

Since the time from the exposure to light to the image development in a high-speed process is short, photoconductors used in such a process are required to have high photoresponsiveness. This is another reason why charge transporting materials are required to have high charge-transportability, which contributes to high light responsiveness, as explained above.

In addition, since it is now demanded that electrophotographic apparatus such as digital copiers and printers be downsized and operable at a higher speed, photoconductors are required to be high sensitive enough to be operable in such a high-speed. Furthermore, photoconductors are also required to be highly reliable so as not to decrease in sensitivity under low temperature environments and to show a little variation in their properties under various environments. These are other reasons why charge-transporting materials are required to have high charge-transportability.

Molecular designing technique has been used for developing such charge-transporting materials that meet the above requirements. As a result, compounds having hydrazone and styryl structures which form largely extended conjugated systems in the basic structures, and bis-enamine compounds have been proposed as superior charge-transporting materials (see, for example, Japanese Patent Publication Nos. Hei 5 (1993)-66587-A, Hei 6 (1994)-348045-A, 2000-235272-A). However, these compounds decrease in sensitivity under low temperature environments. Thus, there is a demand to develop such compounds that show sufficient charge-transportability under low temperature environments.

SUMMARY OF THE INVENTION

An object of the present invention is to provide a highly reliable electrophotographic photoconductor whose properties, such as charge potential, sensitivity, photoresponsiveness and charge-transportability, are not deteriorated even when used under low temperature environments or in a high-speed process, by using an organic photoconductive material having high charge potential, high sensitivity, sufficient photoresponsiveness, and high charge-transportability.

Another object is to provide a highly reliable image-forming apparatus capable of providing high quality images under various environments or in a high-speed process, by using such a photoconductor.

The invention provides an electrophotographic photoconductor comprising an electroconductive substrate and a photosensitive layer provided on the electroconductive substrate, wherein the photosensitive layer comprises a charge-generating material and a charge-transporting material, the charge-transporting material comprising a compound represented by the general formula (1):

wherein $Ar^1$ and $Ar^2$ each independently represent an optionally-substituted arylene or bivalent heterocyclic group; $Ar^3$ and $Ar^4$ each independently represent a hydrogen atom, or an optionally-substituted aryl or monovalent heterocyclic group, but are not simultaneously hydrogen atoms; or $Ar^3$ and $Ar^4$ may be taken together to form an optionally-substituted bivalent cyclic hydrocarbon or heterocyclic group; and n is 0 or 1.

The invention also provides an image-forming apparatus comprising the electrophotographic photoconductor.

BRIEF DESCRIPTION OF THE DRAWINGS

The present invention will become more fully understood from the detailed description provided hereinbelow and the accompanying drawings which are given by way of illustration only, and wherein.

DETAILED DESCRIPTION OF THE INVENTION

Figure 1:
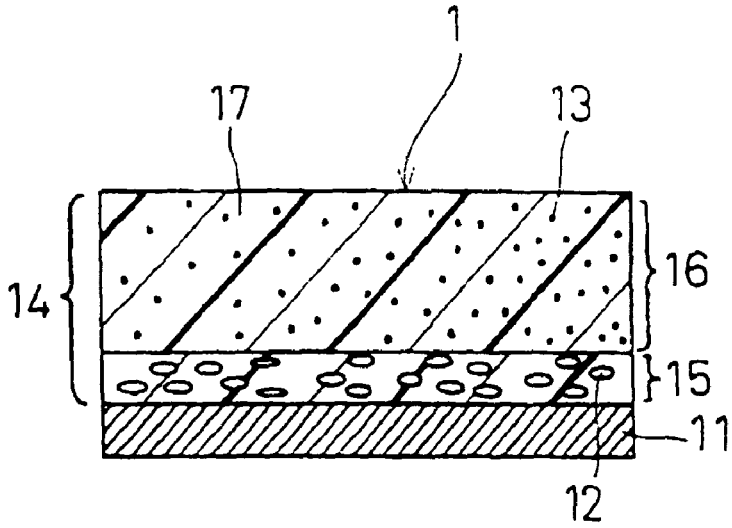
FIG. 1 is a partially sectional view illustrating schematically a photoconductor 1, one embodiment of the electrophotographic photoconductor according to the invention.

Before the invention is described in detail, it must be noted that, as used herein and the appended claims, the singular forms "a", "an" and "the" include plural referents unless the context clearly dictates otherwise.

Organic Photoconductive Materials

The novel compounds which the invention concerns are represented by the following general formula (1):

(1)

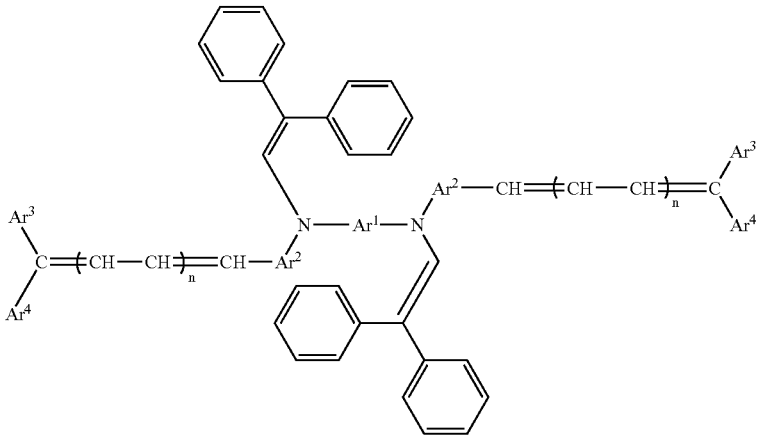

(1)

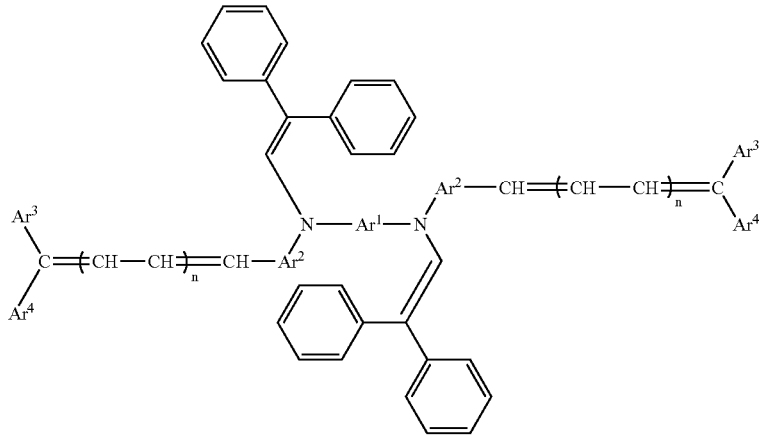

In the general formula (1):

$Ar^1$ and $Ar^2$ each independently represent an optionally-substituted arylene or bivalent heterocyclic group.

Examples of the arylene groups for $Ar^1$ and $Ar^2$ include, but are not limited to, p-phenylene, m-phenylene, 1,4-naphthylene, 2,6-naphthylene, biphenylene, fluorenylene, stilbenzylene, and the like.

Examples of the bivalent heterocyclic groups for $Ar^1$ and $Ar^2$ include, but are not limited to, furylene, thienylene, thiazolylene, benzofurylene, phenylbenzofurylene, carbazolylene, and the like.

The arylene and bivalent heterocyclic groups for $Ar^1$ and $Ar^2$ may be optionally substituted with one or more substituents. Examples of the substituents include, but are not limited to, straight or branched $C_1$-$C_4$ alkyl radicals (which may be further substituted with one or more halogen atoms or $C_1$-$C_4$ alkoxy radicals), straight or branched $C_1$-$C_4$ alkoxy radicals (which may be further substituted with one or more halogen atoms or $C_1$-$C_4$ alkyl radicals), halogen atoms (preferably fluorine atom), phenoxy and phenylthio radicals, and the like. The arylene and bivalent heterocyclic groups may be partially hydrogenated.

$Ar^1$ and $Ar^2$ may be equal to or different from each other.

Specific examples of $Ar^1$ are biphenylene, 3,5'-dimethyl biphenylene, stilbenzylene, phenylbenzofurylene, p-phenylene, m-phenylene, methoxy-p-phenylene, 1,4-naphthylene, 9-dimethyl fluorenylene, 9-ethyl carbazolylene, and 3,5'-difluoro biphenylene.

Specific examples of $Ar^2$ are p-phenylene, 1,4-naphthylene, methyl-p-phenylene, 2,6-naphthylene, methyl-1,4-naphthylene, thienylene, 5,6,7,8-tetrahydro-1,4-naphthylene, methoxy-p-phenylene, 5-methoxy-1,4-naphthylene, and biphenylene.

$Ar^3$ and $Ar^4$ each independently represent a hydrogen atom, or an optionally-substituted aryl or monovalent heterocyclic group.

Examples of the aryl groups for $Ar^3$ and $Ar^4$ include, but are not limited to, phenyl, tolyl, naphthyl, pyrenyl, biphenyl, and the like.

Examples of the monovalent heterocyclic groups for $Ar^3$ and $Ar^4$ include, but are not limited to, furyl, thienyl, thiazolyl, benzofuryl, benzothiophenyl, benzothiazolyl, and the like.

The above aryl and monovalent heterocyclic groups for $Ar^3$ and $Ar^4$ may be optionally substituted with one or more substituents. Examples of the substituents include, but are not limited to, straight or branched $C_1$-$C_4$ alkyl radicals (which may be further substituted with one or more halogen atoms or $C_1$-$C_4$ alkoxy radicals), straight or branched $C_1$-$C_4$ alkoxy radicals (which may be further substituted with one or more halogen atoms or $C_1$-$C_4$ alkyl radicals), halogen atoms (preferably fluorine atom), phenoxy and phenylthio radicals, and the like. The aryl and heterocyclic groups may be partially hydrogenated.

$Ar^3$ and $Ar^4$ may be equal to or different from each other, but cannot be simultaneously hydrogen atoms.

Specific examples of $Ar^3$ and $Ar^4$ are a hydrogen atom, phenyl, methoxy-phenyl, trifluoromethyl-phenyl, methyl-phenyl, thienyl, methoxy-naphthyl, and benzothiazolyl.

Alternatively, $Ar^3$ and $Ar^4$ may be taken together to form a bivalent cyclic hydrocarbon or heterocyclic group.

Examples of the bivalent cyclic hydrocarbon groups that may be formed by $Ar^3$ together with $Ar^4$ include, but are not limited to, condensed polycyclic hydrocarbon groups such as those in which two to four benzene rings and/or 5-membered carbon rings are fused, and those in which two to four benzene rings are fused to a 7-, 8-, 9-, or 10-membered carbon ring.

Examples of the bivalent heterocyclic groups that may be formed by $Ar^3$ together with $Ar^4$ include, but are not limited to, condensed heterocyclic groups such as those in which one or two benzene rings are fused to a 5- or 6-membered heterocycle.

Preferably, the bivalent cyclic hydrocarbon or heterocyclic groups are bivalent groups derived from the corresponding monovalent cyclic hydrocarbon or heterocyclic groups by removal of hydrogen from the carbon atom with a free valence. Examples of such bivalent groups include, but are not limited to, cyclopentylidene, naphthylidene, anthrylidene, dibenzocycloheptylidene, and the like.

The polycyclic hydrocarbon groups may be optionally substituted with one or more substituents. Examples of the substituents include, but are not limited to, straight or branched $C_1$-$C_4$ alkyl radicals (which may be further substituted with one or more halogen atoms or $C_1$-$C_4$ alkoxy radicals), straight or branched $C_1$-$C_4$ alkoxy radicals (which may be further substituted with one or more halogen atoms or $C_1$-$C_4$ alkyl radicals), halogen atoms (preferably fluorine atom), phenoxy and phenylthio radicals, and the like.

n is 0 or 1.

The compounds represented by the general formula (1) generally have two enamine structures and two stilbene or butadiene structures which form extended conjugated systems in their molecules. In the case where $Ar^1$ is stilbenzylene, the compounds have two enamine structures and three stilbene structures in the molecules (cf. Exemplified Compound Nos.: 28 and 29 below).

Such compounds possess many hole hopping sites in their structures and, as a result, have high charge-transportability. Therefore, the compounds represented by the general formula (1) are suitable for photoconductive materials.

In one embodiment, the compounds which the present invention concerns are those represented by the general formula (2):

Examples of the alkyl groups for $R^1$, $R^2$ and $R^3$ include, but are not limited to, straight or branched $C_1$-$C_4$ alkyl radicals (which may be further substituted with one or more halogen atoms or $C_1$-$C_4$ alkoxy radicals). Non-limiting specific examples of the alkyl groups for $R^1$, $R^2$ and $R^3$ are methyl, ethyl, n-propyl, iso-propyl, t-butyl, trifluoromethyl, 2-fluoroethyl, 2,2,2-trifluoroethyl, 1-methoxy ethyl radicals, and the like.

Examples of the alkoxy groups for $R^1$, $R^2$ and $R^3$ include, but are not limited to, straight or branched $C_1$-$C_4$ alkoxy radicals (which may be further substituted with one or more halogen atoms or $C_1$-$C_4$ alkyl radicals). Non-limiting specific examples of the alkoxy groups for $R^1$, $R^2$ and $R^3$ are methoxy, ethoxy, n-propoxy, iso-propoxy, 2-fluoroethoxy, and the like.

The halogen atom is fluorine, chlorine, bromine or iodine atom, and preferably fluorine atom.

(2)

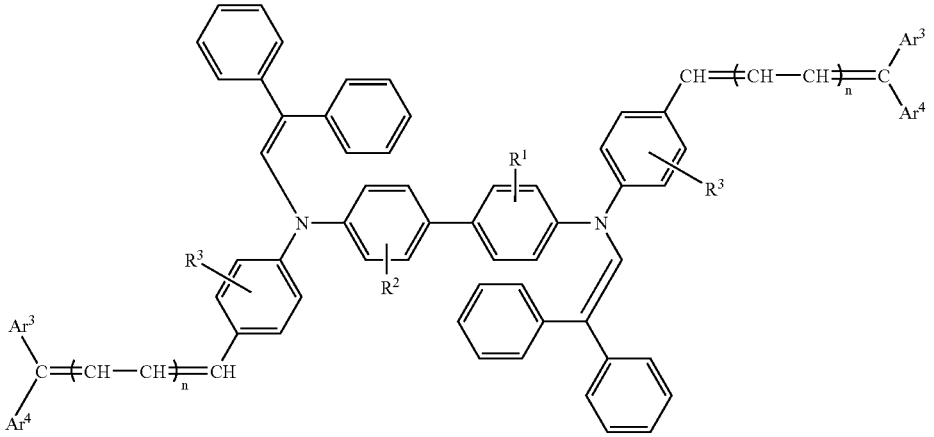

In the general formula (2):

$R^1$, $R^2$ and $R^3$ each independently represent a hydrogen atom, a halogen atom or an optionally-substituted alkyl or alkoxy group.

$Ar^3$, $Ar^4$ and n are the same meanings as defined in the general formula (1).

In another embodiment, the compounds which the present invention concerns are those represented by the general formula (3):

(3)

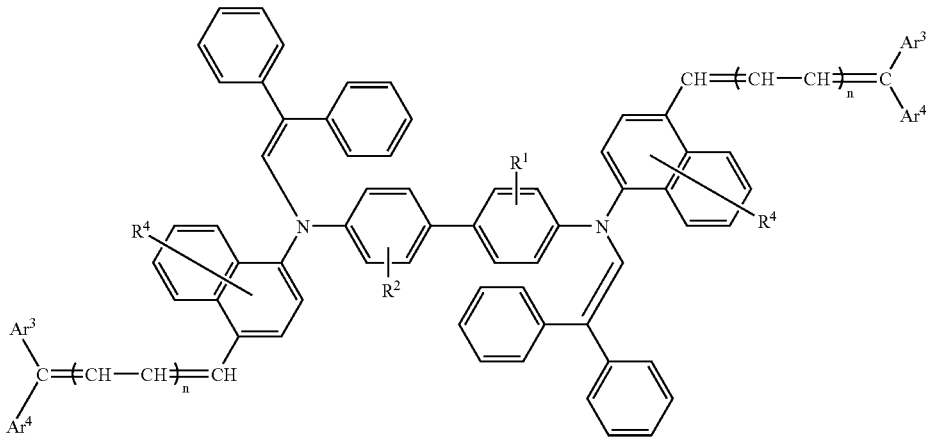

In the general formula (3):

$R^4$ represents a hydrogen atom, or an optionally-substituted alkyl or alkoxy group.

Examples of the alkyl groups for $R^4$ include, but are not limited to, straight or branched $C_1$-$C_4$ alkyl radicals (which may be further substituted with one or more halogen atoms or $C_1$-$C_4$ alkoxy radicals). Non-limiting specific examples of the alkyl groups for $R^4$ are methyl, ethyl, n-propyl, iso-propyl, t-butyl, trifluoromethyl, 2-fluoroethyl, 2,2,2-trifluoroethyl, 1-methoxy ethyl radicals, and the like.

Examples of the alkoxy groups for $R^4$ include, but are not limited to, straight or branched $C_1$-$C_4$ alkoxy radicals (which may be further substituted with one or more halogen atoms or $C_1$-$C_4$ alkyl radicals). Non-limiting specific examples of the alkoxy groups for $R^4$ are methoxy, ethoxy, n-propoxy, iso-propoxy, 2-fluoroethoxy, and the like.

$Ar^3$, $Ar^4$, $R^1$, $R^2$, $R^3$ and n are the same meanings as defined in the general formulae (1) and (2).

In view of properties, costs and productivity, especially preferable for organic photoconductive materials are the compounds represented by the general formula (1) wherein $Ar^1$ is a biphenylene group, $Ar^2$ is a p-phenylene or 1,4-naphthylene group, $Ar^3$ is a phenyl or p-methoxyphenyl group, $Ar^4$ is a hydrogen atom, and n is 0 or 1.

Specific examples of the compounds which the invention concerns include, but are not limited to, those having a set of substituent groups listed in Table 1 below. The groups indicated in Table 1 correspond to the substituent groups in the general formula (1). For example, Exemplified Compound No. 1 in Table 1 is the compound represented by the following structural formula (1-1):

TABLE 1

(1-1)

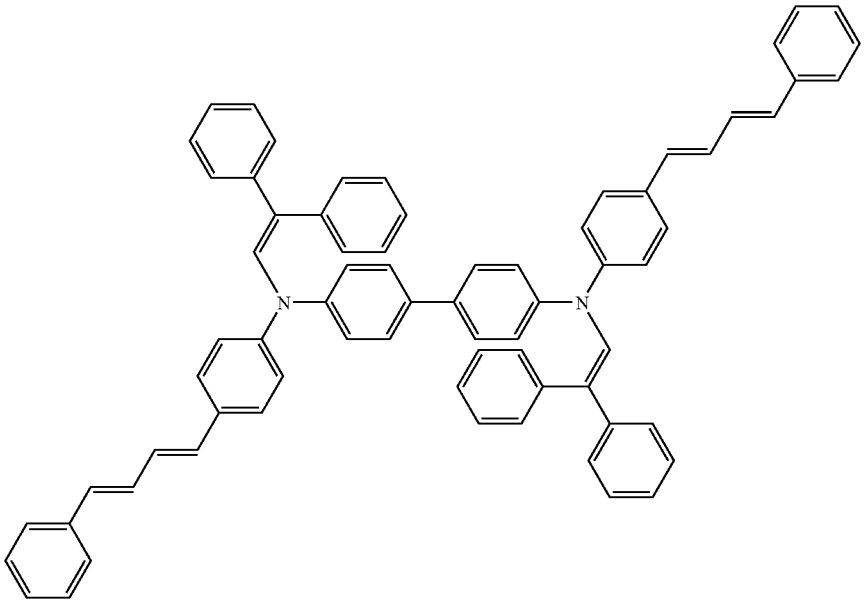

| Exemplified Compound No. | $Ar^1$ | N—$Ar^2$ | $Ar^3$ | $Ar^4$ | n |
|---|---|---|---|---|---|
| 1 | 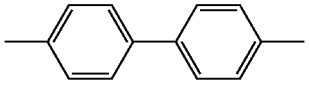 | 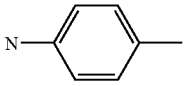 | 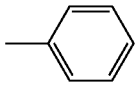 | H | 1 |
| 2 | 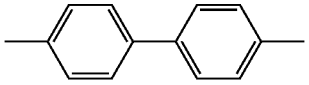 | 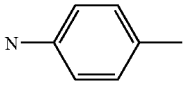 | 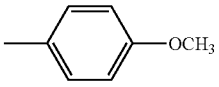 | H | 1 |
| 3 | 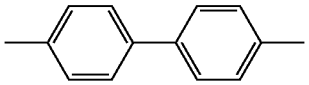 | 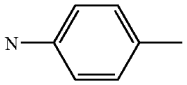 | 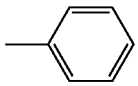 | 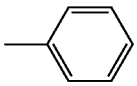 | 1 |
| 4 | 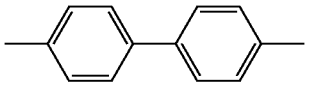 | 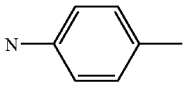 | 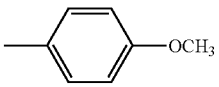 | H | 0 |

TABLE 1-continued
| | | | | | |
|---|---|---|---|---|---|
| 5 | 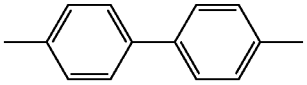 | 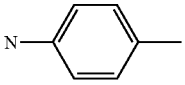 | 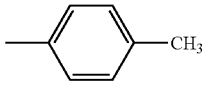 | H | 0 |
| 6 | 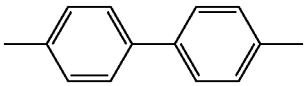 | 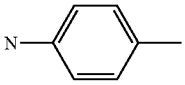 | 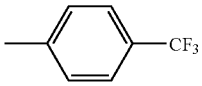 | H | 0 |
| 7 | 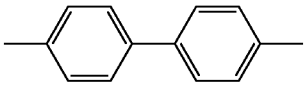 | 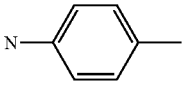 | 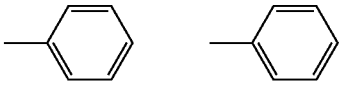 | | 0 |
| 8 | 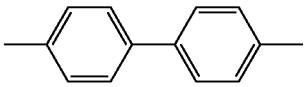 | 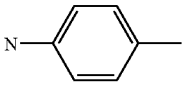 | 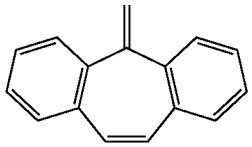 | | 0 |
| 9 | 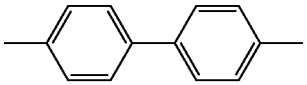 | 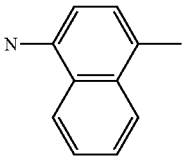 | 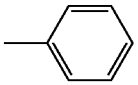 | H | 1 |
| 10 | 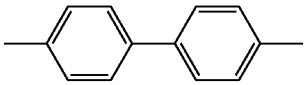 | 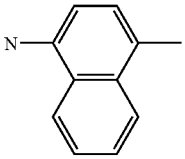 | 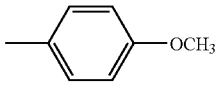 | H | 1 |
| 11 | 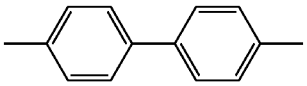 | 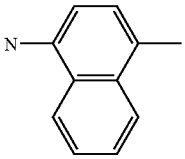 | 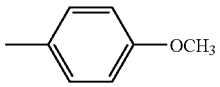 | H | 0 |
| 12 | 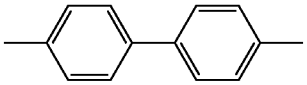 | 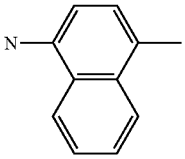 | 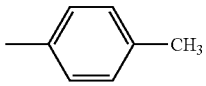 | H | 0 |
| 13 | 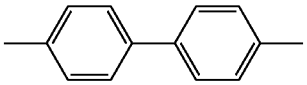 | 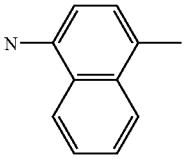 | 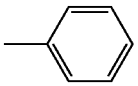 | H | 0 |
| 14 | 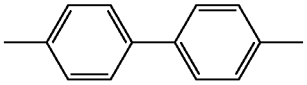 | 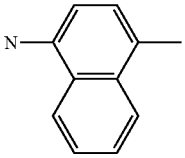 | 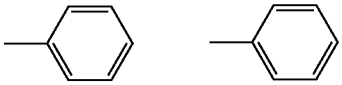 | | 0 |
| 15 | 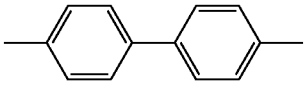 | 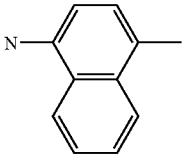 | 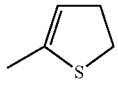 | H | 0 |

TABLE 1-continued
| | | | | | |
|---|---|---|---|---|---|
| 16 | 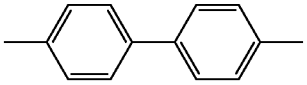 | 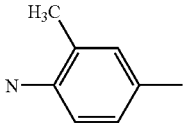 | 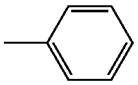 | H | 1 |
| 17 | 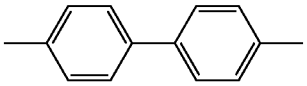 | 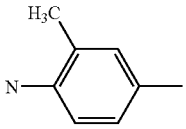 | 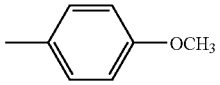 | H | 0 |
| 18 | 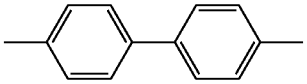 | 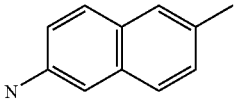 | 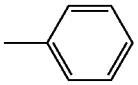 | H | 1 |
| 19 | 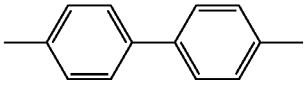 | 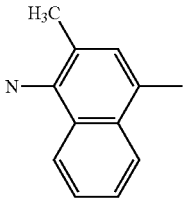 | 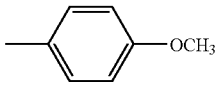 | H | 0 |
| 20 | 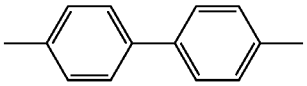 | 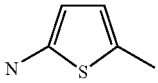 | 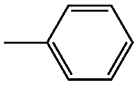 | H | 1 |
| 21 | 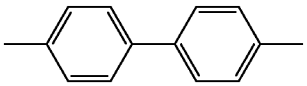 | 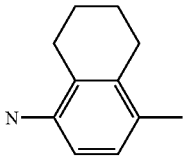 | 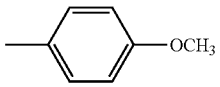 | H | 0 |
| 22 | 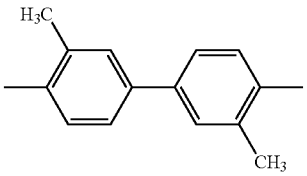 | 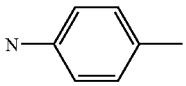 | 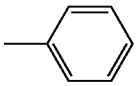 | H | 1 |
| 23 | 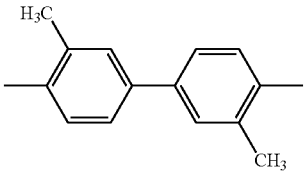 | 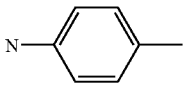 | 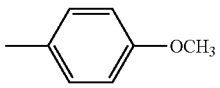 | H | 1 |
| 24 | 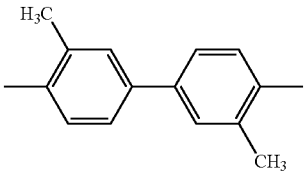 | 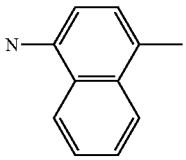 | 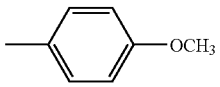 | H | 0 |
| 25 | 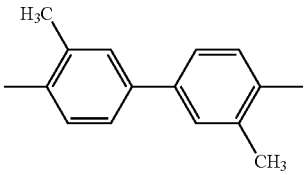 | 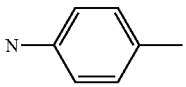 | 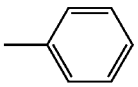 | 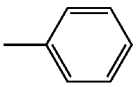 | 0 |

TABLE 1-continued
| | | | | | |
|---|---|---|---|---|---|
| 26 | 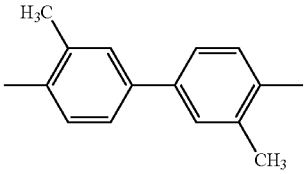 | 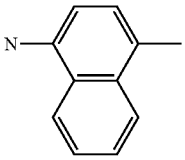 | 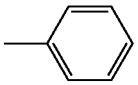 | H | 1 |
| 27 | 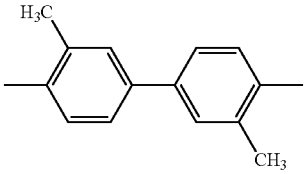 | 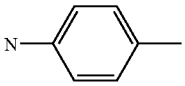 | 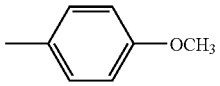 | H | 0 |
| 28 | 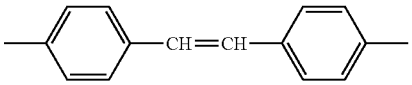 | 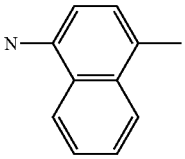 | 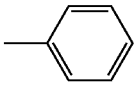 | H | 1 |
| 29 | 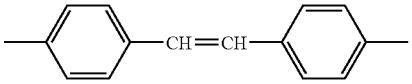 | 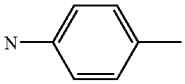 | 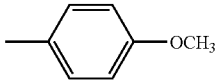 | H | 0 |
| 30 | 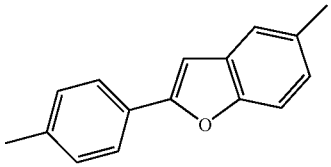 | 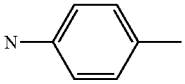 | 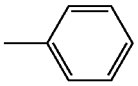 | H | 1 |
| 31 | 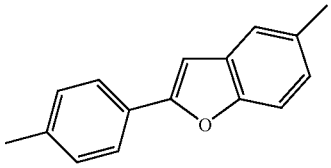 | 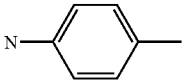 | 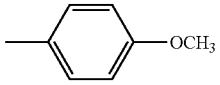 | H | 1 |
| 32 | 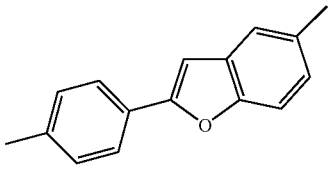 | 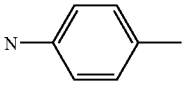 | 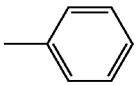 | 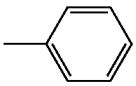 | 1 |
| 33 | 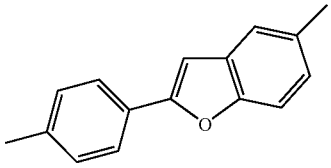 | 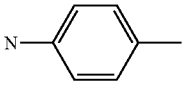 | 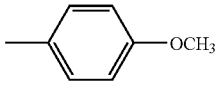 | H | 0 |
| 34 | 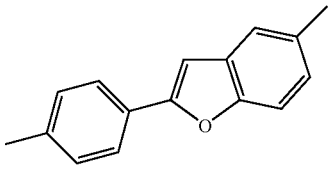 | 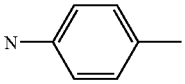 | 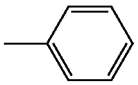 | 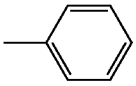 | 0 |

TABLE 1-continued
| | | | | | |
|---|---|---|---|---|---|
| 35 | 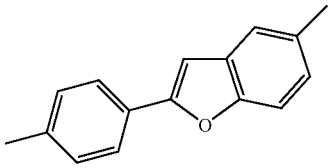 | 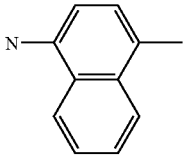 | 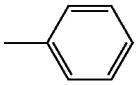 | H | 1 |
| 36 | 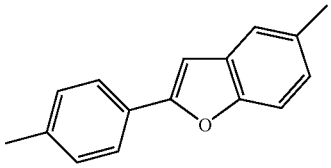 | 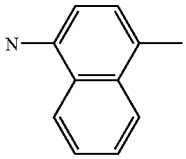 | 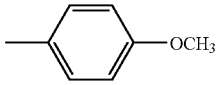 | H | 0 |
| 37 | 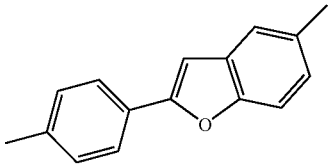 | 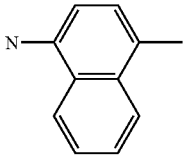 | 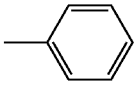 | 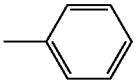 | 0 |
| 38 | 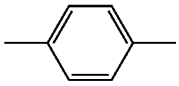 | 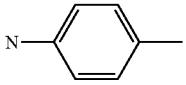 | 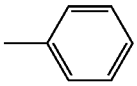 | H | 1 |
| 39 | 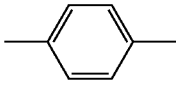 | 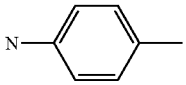 | 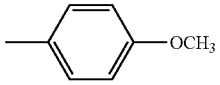 | H | 0 |
| 40 | 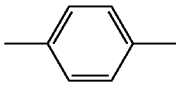 | 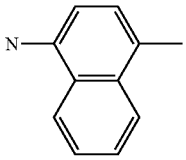 | 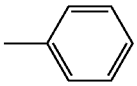 | 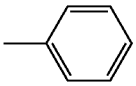 | 0 |
| 41 | 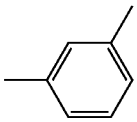 | 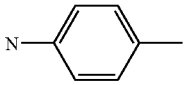 | 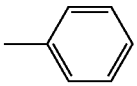 | H | 1 |
| 42 | 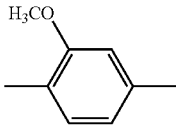 | 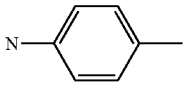 | 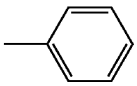 | H | 1 |
| 43 | 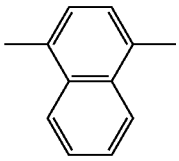 | 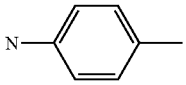 | 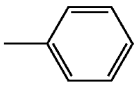 | H | 1 |

TABLE 1-continued
| | | | | | |
|---|---|---|---|---|---|
| 44 | 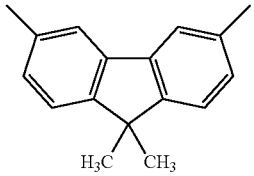 | 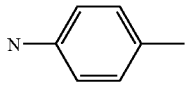 | 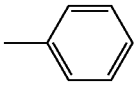 | H | 1 |
| 45 | 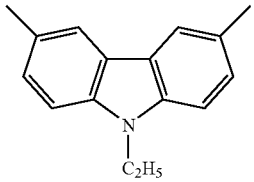 | 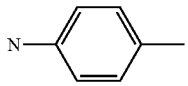 | 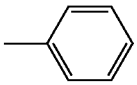 | H | 1 |
| 46 | 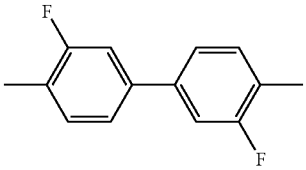 | 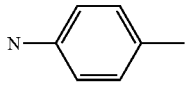 | 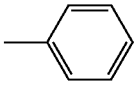 | H | 1 |
| 47 | 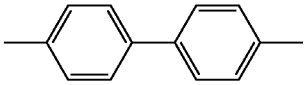 | 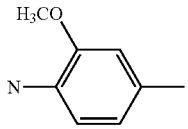 | 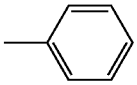 | H | 1 |
| 48 | 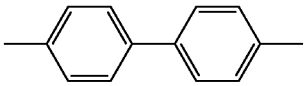 | 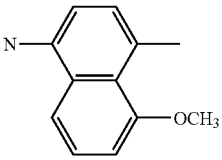 | 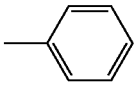 | H | 1 |
| 49 | 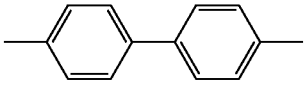 | 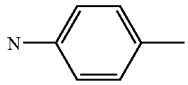 | 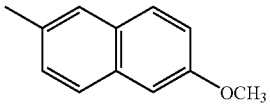 | H | 0 |
| 50 | 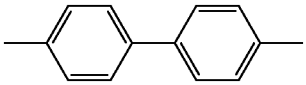 | 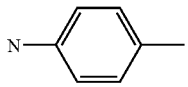 | 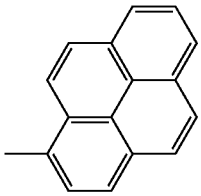 | H | 0 |
| 51 | 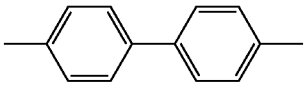 | 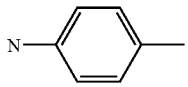 | 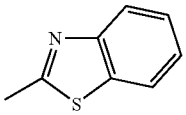 | H | 0 |
| 52 | 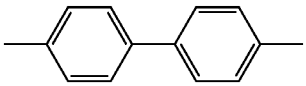 | 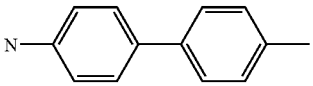 | 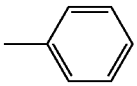 | H | 1 |

In the invention, the compounds represented by the general formula (1) are novel and they can be produced, for example, as follows.

A bis-enamine compound represented by the general formula (4):

(4)

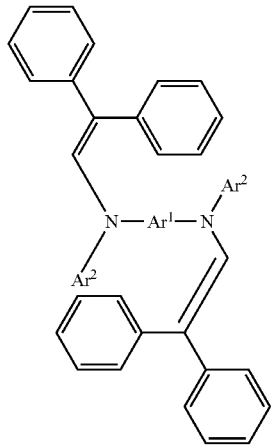

wherein $Ar^1$ and $Ar^2$ are the same meanings as defined in the general formula (1), is synthesized according to, for example, the method as described in Japanese Patent Publication No. Hei 6 (1994)-348045-A, the disclosure of which is incorporated herein in its entirety by reference for any and all purposes.

Then, the compound as represented by the general formula (4) is formylated by the Vilsmeier reaction to give an aldehyde compound represented by the general formula (5):

(5)

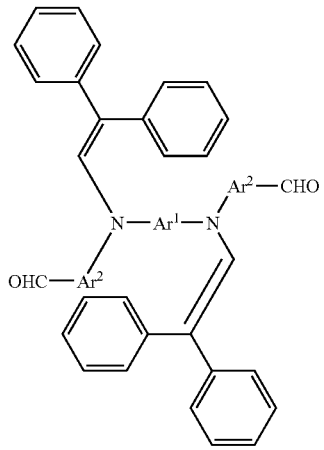

wherein $Ar^1$ and $Ar^2$ are the same meanings as defined in the general formula (1).

The Vilsmeier reaction is carried out as described below, for example.

First, to a solvent such as N,N-dimethylformamide (DMF) or 1,2-dichloroethane, added are phosphorus oxychloride and N,N-dimethylformamide, phosphorus oxychloride and N-methyl-N-phenylformamide, or phosphorus oxychloride and N,N-diphenylformamide, to prepare a Vilsmeier reagent, according to a known method.

To 1.0 to 1.3 equivalents of the prepared Vilsmeier reagent, added is 1.0 equivalent of the bis-enamine compound as represented by the general formula (4), and the resulting mixture is heated to 60 to 110° C. and stirred for 2 to 8 hours. The mixture is then subjected to alkaline hydrolysis with a 1 to 8 N aqueous solution of sodium hydroxide, potassium hydroxide or the like, to give the aldehyde compound as represented by the general formula (5) in high yield.

The aldehyde compound as represented by the general formula (5) is then subjected to the Wittig-Horner reaction, i.e., reacted with a Wittig reagent as represented by the general formula (6-1) or (6-2) under a basic condition, so as to give a compound represented by the general formula (1). If the Wittig reagent as represented by the general formula (6-1) is used, the Wittig-Horner reaction produces such an enamine compound as represented by the general formula (1) where n is 0 that has stilbene structures. If the Wittig reagent as represented by the general formula (6-2) is used, the Wittig-Horner reaction produces such an enamine compound as represented by the general formula (1) where n is 1 that has butadiene structures.

(6-1)

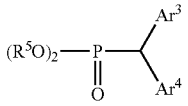

(wherein $Ar^3$ and $Ar^4$ are the same meanings as defined in the general formula (1), and $R^5$ represents an optionally-substituted alkyl or aryl group)

(6-2)

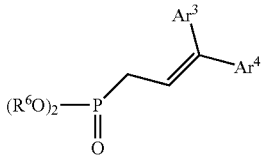

(wherein $Ar^3$ and $Ar^4$ are the same meanings as defined in the general formula (1), and $R^6$ represents an optionally-substituted alkyl or aryl group)

The Wittig-Horner reaction is carried out as described below, for example.

A mixture of 1.0 equivalent of an aldehyde compound represented by the general formula (5), 1.0 to 1.2 equivalents of a Wittig reagent represented by the general formula (6-1) or (6-2) and 1.0 to 1.5 equivalents of a metal alkoxide in a suitable solvent is stirred for 2 to 8 hours at a room temperature or a temperature of 30 to 60° C., to give a charge-transporting material represented by the general formula (1) in high yield.

Examples of the solvents that may be used for the Wittig-Horner reaction include, but are not limited to, toluene, xylene, diethylether, tetrahydrofuran (THF), ethyleneglycol dimethylether, N,N-dimethylformamide, dimethylsulfoxide (DMSO), and the like. Examples of the metal alkoxides that may be used for the Wittig-Horner reaction include, but are not limited to, potassium t-butoxide, sodium ethoxide, sodium methoxide and the like.

The novel compounds represented by the general formula (1) according to the present invention exhibit high charge-transportability even under low temperature environments, since they each have two enamine structures and two stilbene or butadiene structures which form extended conjugated systems in the molecules, and have many hole hopping sites in their structures. Therefore, the compounds represented by the general formula (1) are suitable for using as a charge-transporting material in a photosensitive layer in order to prepare a highly reliable photoconductor.

In addition, the present compounds can be applied as or for sensor materials, EL devices or electrostatic recording devices so as to provide various devices having enhanced sensitivity and good photoresponsiveness.

Electrophotographic Photoconductor

The electrophotographic photoconductor according to the present invention comprises an electroconductive substrate and a photosensitive layer provided on or over the electroconductive substrate, wherein the photosensitive layer comprises a charge-generating material and a charge-transporting material, the charge-transporting material comprising a compound represented by the general formula (1), in particular a compound represented by the general formula (2) or (3).

The electrophotographic photoconductor according to the invention is highly reliable one that has high electric potential of charge, high sensitivity and sufficient photoresponsiveness, and does not deteriorate these properties even when used under low temperature environments or in a high-speed process, because a compound represented by the general formula (1) having high charge-transportability is used as a charge-transporting material in the photosensitive layer.

In one embodiment, the present electrophotographic photoconductor comprises, as a charge-generating material, oxotitanium phthalocyanine that presents at least a peak at the Bragg angle ($2\theta \pm 0.2°$) of 27.2° in the diffraction spectrum as observed with the Cu—Kα characteristic X-ray having a wavelength of 1.54 Å.

Such oxotitanium phthalocyanine can absorb light to generate a large quantity of charges, and inject the generated charges into a charge-transporting material efficiently without accumulating them inside. In the photoconductor of the present embodiment, therefore, the oxotitanium phthalocyanine generates a large quantity of charges when it absorbs light, and efficiently injects the charges into the compound as represented by the general formula (1) having high charge mobility. Then, the compound in turn transports the charges smoothly (at high mobility). Thus, according to this embodiment, the electrophotographic photoconductor can be provided to have higher sensitivity and higher resolution.

In another embodiment, there is provided the electrophotographic photoconductor wherein the photosensitive layer has a multi-layered structure which comprises a charge generation layer comprising the charge-generating material and a charge transport layer comprising the charge-transporting material. According to this embodiment, the charge generation and charge transport functions are respectively served by different layers, and thus the optimal charge-generating material and the optimal charge-transporting material can be selected independently. As a result, the electrophotographic photoconductor of this embodiment can be provided to have higher sensitivity, increased stability in repeated use, and higher durability. The electrophotographic photoconductor also can be relatively easily produced to have any desired properties.

In a particular embodiment, the charge transport layer further comprises a binder resin, and a ratio by weight (A/B) of the charge-transporting material (A) to the binder resin (B) in the charge transport layer ranges from 10/12 to 10/30. In the present invention, since the charge-transporting material comprises the compound as represented by the general formula (1) which has high charge mobility, higher proportion of the binder resin can be contained in the charge-transport layer, as compared to the case where a conventional charge-transporting material is used alone, while maintaining the photoresponsiveness of the photoconductor. Therefore, there can be provided the electrophotographic photoconductor of this embodiment which is improved in the printing durability of the charge transport layer but does not decrease in the photoresponsiveness. In this case, the durability can be further increased due to the synergic effect between higher proportion of the binder resin and the hard wearing properties of the compound as represented by the general formula (1) itself.

In yet another embodiment, the electrophotographic photoconductor further comprises an interlayer between the electroconductive substrate and the photosensitive layer. According to this embodiment, the interlayer inhibits the injection of charges from the electroconductive substrate into the photosensitive layer, and thus the chargeability of the photosensitive layer may be prevented from decreasing. Accordingly, in this embodiment, the surface charge decrease can be inhibited in the area where is not exposed to light. As a result, in image forming with the photoconductor of this embodiment, the occurrence of defects such as fogging is decreased.

In addition, the interlayer can cover the surface defects of the electroconductive substrate, and thereby allowing a good formation of the photosensitive layer over the electroconductive substrate. Further, the interlayer can increase the adhesiveness between the electroconductive substrate and the photosensitive layer and thus inhibit delamination of the layers.

Image-Forming Apparatus

The image-forming apparatus according to the present invention comprises the electrophotographic photoconductor as described above.

The present image-forming apparatus is reliable so that it can form a high quality image under various environments. This is because the present apparatus comprises the photoconductor, as described above, that has high charge potential, high sensitivity, sufficient photoresponsiveness and superior durability, and does not deteriorate these properties even when used under low temperature environments or in a high-speed process.

The image-forming apparatus can be any of various types of copiers, facsimile machines, printers, and composite machines thereof, whether monochrome or color imaging, so long as they use electrophotographic process.

DETAILED DESCRIPTION OF THE PREFERRED EMBODIMENTS

While some preferred embodiments of the electrophotographic photoconductors and the image-forming apparatuses according to the present invention will be now described with reference to the attached drawings, it is to be understood that the invention is not limited to the embodiments as described below.

Any person skilled in the art will recognize from the description herein and the drawings attached hereto that various modifications, variations and changes can be made to any of the preferred embodiments of the invention without departing from the spirit and scope of the present invention. Thus, it is intended that the present invention covers such modifications, variations and changes as come within the scope of the appended claims and their equivalents.

FIG. 1 is a partially sectional view illustrating schematically a photoconductor 1, one embodiment of the electrophotographic photoconductor according to present invention. In the present embodiment, the photosensitive layer comprises a charge generation layer and a charge transport layer. The photoconductor 1 comprises an electroconductive substrate 11 comprised of a photoconductive material, a charge generation layer 15 layered on the substrate 11 and containing a charge-generating material 12, and a charge transport layer 16 layered on the charge generation layer 15 and containing a charge-transporting material 13. The charge generation layer 15 and the charge transport layer 16 constitute a photosensitive layer 14 of a multi-layered structure. In other words, the photoconductor 1 is a multi-layer electrophotographic photoconductor.

Electroconductive Substrate

The electroconductive substrate 11 plays a role of the electrode of the photoconductor 1 and also functions as a supporting member for the layers provided thereon (the layers 15, 16). The substrate 11 is illustrated in the form of a sheet in the figure, although it may be in the form of, for example, a cylinder, a drum, an endless belt or the like.

In the present invention, the electroconductive substrate may be any electroconductive substrate that can be used in an electrophotographic photoconductor. The electroconductive materials that may be used for the electroconductive substrate include, but are not limited to, metals such as aluminum, copper, zinc, and titanium; metal alloys such as aluminum alloys, stainless steel; polymer materials such as polyethylene terephthalate, nylon, and polystyrene; substrates (e.g., hard paper, glass, and the like) with a metal foil laminated top, with a metallic material evaporated top, or with an evaporated or applied top layer of electroconductive compound such as an electroconductive polymer, tin oxide, and indium oxide. These materials can be formed into any suitable shape for electroconductive substrates of photoconductors.

The surface of the electroconductive substrate 11 may be subjected to anodic oxidation coating; treatment with chemicals, hot water or the like; coloring; roughening for irregular reflection; or the like, so far as the quality of the images to be obtained is not deteriorated. In an electrophotographic process with the use of a laser as a light source for exposure, since laser light has almost a single wavelength, the light reflected from the surface and the light reflected inside of the photoconductor may interfere with each other so as to cause interference fringes on the image, which may result in image defects. However, such image defects can be prevented by the above mentioned treatment of the surface of the substrate 11.

Charge Generation Layer

The charge generation layer 15 provided on the electroconductive substrate 11 comprises the charge-generating material 12 that is capable of absorbing light to generate charges.

Examples of the charge-generating materials include, but are not limited to, organic photoconductive materials including azo pigments such as monoazo, bisazo and trisazo pigments, indigoid pigments such as indigo and thioindigo, perylene pigments such as perylenimide and perylenic anhydride, polycyclic quinone pigments such as anthraquinone and pyrenequinone, phthalocyanine compounds such as metal phthalocyanines (e.g., oxotitanium phthalocyanine compounds) and metal-free phthalocyanines, squarylium dyes, pyrylium and thiopyrylium salts, and triphenylmethane dyes; and inorganic photoconductive materials such as selenium and amorphous silicon. One or more charge-generating materials are used in the charge generation layer.

Of the above-mentioned materials, preferred are phthalocyanine compounds, and particularly oxotitanium phthalocyanine compounds. In the present invention, the oxotitanium phthalocyanine compounds mean oxotitanium phthalocyanine and derivatives thereof. The derivatives of oxotitanium phthalocyanine include, but are not limited to, those where one or more hydrogen atoms on the aromatic ring of the phthalocyanine moiety are replaced with, for example, a halogen atom such as a chlorine or fluorine atom, a nitro group, a cyano group, a sulfonic acid group or the like; those where the central metal, that is, a titanium atom, is coordinated with ligands such as chlorine atoms; and the like.

The oxotitanium phthalocyanine compounds preferably have specific crystalline structures. Examples of such preferable oxotitanium phthalocyanines are those that have crystalline structures that present at least a peak at the Bragg angle ($2\theta \pm 0.2°$) of 27.2° in the diffraction spectrum as observed with the Cu—K$\alpha$ characteristic X-ray having a wavelength of 1.54 Å, wherein the Bragg angle $2\theta$ means a diffraction angle, or the angle between the incident X-ray and a diffracted X-ray.

It is especially preferable to use such an oxotitanium phthalocyanine compound that has the above-mentioned structure as a charge-generating material in combination with the charge-transporting material as represented by the general formula (1), since in such a case, the photoconductor can be further improved in sensitivity and resolution. In the charge generation layer 15, the oxotitanium phthalocyanine compounds, having superior charge-generating and charge-injecting abilities, can generate a large quantity of charges when absorbing light and then inject the charges into the charge transport layer 16 efficiently without accumulating them inside. In the charge transport layer 16, the charges can be efficiently injected into the compound as represented by the general formula (1) as the charge-transporting material 13. Then, the compound can smoothly transport the charges, due to its high charge mobility. Accordingly, the electrophotographic photoconductor can be provided to have higher sensitivity and resolution.

The oxotitanium phthalocyanine compounds can be prepared by any of the methods known in the art, for example, the method described in Moser and Thomas, Phthalocyanine Compounds, Reinhold Publishing Corp., New York, 1963, the disclosure of which is incorporated herein in its entirety by reference for any and all purposes. Oxotitanium phthalocyanine can be prepared, for example, by heat-melting phthalonitrile and titanium tetrachloride, or heating and reacting between them in a suitable solvent such as $\alpha$-chloronaphthalene, to synthesize dichlorotitanium phthalocyanine, and then hydrolyzing it with a base or water. The oxotitanium phthalocyanine also can be prepared by heating and reacting isoindoline and titanium tetraalkoxide such as tetrabutoxy titanium in a suitable solvent such as N-methylpyrrolidone.

The charge-generating materials may be used in combination with a sensitizing dye. The combined use can further improve the sensitivity of the photoconductor. The combined use can also suppress residual potential increase and charge potential decrease after repeated use, resulting in improvement in the electrical durability of the photoconductor.

Examples of the sensitizing dyes include, but are not limited to, triphenylmethane dyes such as methyl violet, crystal violet, night blue and Victoria blue; acridine dyes such as erythrosine, rhodamine B, rhodamine 3R, acridine orange and flapeosine; thiazine dyes such as methylene blue and methylene green; oxazine dyes such as capri blue and meldola blue; cyanine dyes; styryl dyes; pyrylium salt dyes; and thiopyrylium salt dyes.

The charge generation layer 15 may contain a binder resin so as to improve its integrity. Examples of the binder resins include, but are not limited to, resins such as polyester resins, polystyrene resins, polyurethane resins, phenolic resins, alkyd resins, melamine resins, epoxy resins, silicone resins, acrylic resins, methacrylic resins, polycarbonate resins, polyarylate resins, phenoxy resins, polyvinyl butyral resins and polyvinyl formal resins; and copolymer resins containing at least two of the repeating units constituting the aforesaid resins. Specific examples of the copolymer resins are insulating resins such as vinyl chloride-vinyl acetate copolymer resins, vinyl chloride-vinyl acetate-maleic anhydride copolymer resins and acrylonitrile-styrene copolymer resins. Any of the resins commonly used in the art may be used as a binder resin. A binder resin may be used alone, or a combination of two or more binder resins may be used.

The proportion of the charge-generating material in the charge generation layer 15 preferably ranges from 10% to 99% by weight. When the proportion is lower than 10% by weight, the sensitivity of the photoconductor may decrease. When the proportion exceeds 99% by weight, the strength of the charge generation layer 15 may be reduced since the binder resin content is too low. In addition, the dispersibility of the charge-generating material in the charge generation layer 15 may decrease, and thereby facilitating aggregation of the charge-generating materials. The resulting coarse aggregates may cause a decrease in charge in a portion of the photoconductor surface which is not exposed to light in a step of light exposing. Accordingly, image defects may frequently occur, including image fogging due to unwanted black dots formed in the area to be white on a recording medium.

The methods for forming the charge generation layer 15 include, but are not limited to, vacuum deposition methods, in which the charge-generating material is vacuum-deposited on the surface of electroconductive substrate 11, and application methods, in which a coating liquid containing the charge-generating material is applied on the surface of the substrate 11. Out of them, the application methods are preferred since they are simple.

The coating liquid for forming the charge generation layer is prepared, for example, by dispersing the charge-generating material and optionally a binder resin in a suitable solvent by a method known in the art.

The solvents that may be used in the charge generation layer coating liquid include, but are not limited to, halogenized hydrocarbons such as dichloromethane and dichloroethane; ketones such as acetone, methyl ethyl ketone and cyclohexanone; esters such as ethyl acetate and butyl acetate; ethers such as tetrahydrofuran and dioxane; alkyl ethers of ethylene glycol such as 1,2-dimethoxyethane; aromatic hydrocarbons such as benzene, toluene and xylene; and aprotic polar solvents such as N,N-dimethylformamide and N,N-dimethylacetamide. A solvent may be used alone, or a mixture of two or more solvents may be used.

The charge-generating material may be ground by a grinder, such as a ball mill, a sand mill, an attritor, a shaking mill and an ultrasonic disperser, before being dispersed in a solvent. For dispersing the charge-generating materials in a solvent, a disperser such as a paint shaker, a ball mill or a sand mill may be used. The dispersion conditions can be selected appropriately so as to prevent contamination, of the resulting dispersion with, for example, ablated matters from the vessel or the disperser used.

The application of the charge generation layer coating liquid may be carried out by, for example, spraying, bar coating, roll coating, blade coating, ring coating, or dip coating method. Out of them, preferred is the dip coating method, in which a substrate is dipped in a coating liquid and then withdrawn from the liquid at a constant rate or varying rates, thereby forming a coating layer on the substrate surface, since the method is relatively simple and superior in productivity and production costs. In dip coating, a disperser such as an ultrasonic generator may be used so as to maintain the dispersion state in the coating liquid. An optimal application method of the charge generation layer coating liquid can be appropriately selected from those methods described above and other methods known in the art, by taking into account the physical properties of the coating liquid to be used, the productivity and the like.

The thickness of the charge generation layer 15 preferably ranges from 0.05 μm to 5 μm, more preferably from 0.1 μm to 1 μm. As the thickness is smaller than 0.05 μm, the light absorption efficiency of the layer 15 and thus the sensitivity of the photoconductor 1 may decrease. As the thickness is larger than 5 μm, the charge transfer inside the layer 15 may be rate-limiting in the process of erasing the charges on the surface of the photosensitive layer 14, decreasing the sensitivity of the photoconductor 1.

Charge Transport Layer

The charge transport layer 16 is provided to contain a compound represented by the general formula (1), in particular a compound represented by the general formula (2) or (3), as the charge-transporting material 13 which accepts and transports the charges generated by the charge-generating material 12, in the binder resin 17.

As the charge-transporting material as represented by the general formula (1), one of Exemplified Compound Nos. 1 to 52 shown in Table 1 may be used alone, or two or more of them may be used in combination. The charge-transporting compound as represented by the general formula (1) may be used in combination with any other charge-transporting material.

Examples of such other charge-transporting materials include, but are not limited to, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives and benzidine derivatives, as well as polymers having groups derived from the aforesaid derivatives or compounds in the main chain or a side chainbranch, such as poly-N-vinylcarbazole, poly-1-vinylpyrene and poly-9-vinylanthracene.

It is preferable that the all contained as the charge-transporting material 13 is the compound as represented by the general formula (1), in particular, the compound as represented by (2) or (3), since in such a case, much higher charge-transportability of the charge transport layer is realized.

As the binder resin 17 for forming the charge transport layer 16, such resins that are well compatible with the charge-transporting material 13 can be used. Specific examples of such resins include, but are not limited to, vinyl polymer resins such as polymethyl methacrylate resins, polystyrene resins and polyvinyl chloride resins, and copolymers comprising two or more of the repeating units constituting the aforesaid polymers, and polycarbonate resins, polyester resins, polyester carbonate resins, polysulfone resins, phenoxy resins, epoxy resins, silicone resins, polyarylate resins, polyamide resins, polyether resins, polyurethane resins, polyacrylamide resins and phenolic resins, as well as thermosetting resins that are obtained by partially cross-linking the aforesaid resins. A resin may be used alone, or two or more resins may be use in combination.

Of the resins mentioned above, polystyrene resins, polycarbonate resins, polyarylate resins and polyphenylene oxides are preferred, since they are good electric insulator with a volume resistivity of $10^{13}$ Ω·cm or more, and exhibit good film formability and electrical potential properties.

In the charge transport layer 16, the weight ratio (B/A) of the binder resin 17 (B) to the charge-transporting material 13 (A) preferably ranges from 1.2 to 3.0.

When the charge transport layer 16 contains a high proportion of the binder resin 17 so that the weight ratio B/A is 1.2 or more, the layer 16 can be improved in the printing durability. In a photoconductor with the use only of a conventional charge-transporting material, the use of such a high proportion of the binder resin, or a relatively decreased amount of the conventional charge-transporting material, in the layer causes insufficient photoresponsiveness of the photoconductor, resulting in the occurrence of image defects. In contrast, the photoconductor 1 according to the present invention exhibits sufficiently high photoresponsiveness and provides high quality images even when the charge transport layer 16 contains a high proportion of the binder resin 17 so that the ratio B/A is 1.2 or more, since the compound as represented by the general formula (1) has superior charge-transportability. The use of the compound as represented by the general formula (1) as a charge-transporting material allows the photoconductor 1 to be improved in the printing durability of the charge transport layer 16 without lowering photoresponsiveness and in the mechanical durability of the photoconductor itself.

However, if the weight ratio B/A is larger than 3.0, the proportion of the binder resin may be so high as to reduce the photosensitivity of the photoconductor 1. In addition, in the case where the charge transport layer 16 is formed by dip coating, it may be possible that the viscosity of the coating liquid used increases and thus the coating rate decreases, and as a result, the productivity is significantly worsened. If the amount of the solvent in the coating liquid is increased to lower the viscosity, the charge transport layer 16 may be clouded due to blushing.

If the ratio B/A is less than 1.2, the proportion of the binder resin may be so low as to decrease the printing durability of the charge transport layer 16, thereby increasing the abrasion of the photosensitive layer 14 and decreasing the chargeability of the photoconductor 1.

The charge transport layer 16 may contain any optional additive such as a plasticizer, a leveling agent, an antioxidant and/or a sensitizer. The use of plasticizer and/or leveling agent can improve the film formability, flexibility and the surface smoothness. The use of antioxidant and/or sensitizer can improve the potential properties of the layer and reduce fatigue failure that occurs when the photoconductor is used repeatedly, thereby improving the layer in the durability. In addition, the addition of antioxidant in a charge transport layer coating liquid can stabilize the coating liquid.

Examples of the plasticizers include, but are not limited to, dibasic esters such as phthalate esters, fatty acid esters, phosphate esters, chlorinated paraffins and epoxy plasticizers. Examples of the leveling agents include, but are not limited to, silicone leveling agents such as dimethyl silicone, diphenyl silicone and phenylmethyl silicone.

As the antioxidant, a hindered phenol derivative and/or a hindered amine derivative is preferably used. The hindered phenol derivative and the hindered amine derivative may be mixed in any desired proportion. It is preferable that the amount of the hindered phenol derivative and/or the hindered amine derivative to be used is from 0.1 to 50% by weight with respect to the weight of the charge-transporting material 13. When this amount is 0.1% or more by weight, the stability of the charge transport layer coating liquid and the durability of the photoconductor can be further improved. However, if this amount is more than 50% by weight, the photoconductor properties may be adversely affected.

The charge transport layer 16 may also contain fine particles of inorganic and/or organic compounds so as to increase the mechanical strength and to improve the electrical properties. Specific examples of the inorganic particles are particles of a metal oxide such as titanium oxide. Specific examples of organic particles are particles of a polymer containing a fluorine atom, such as tetrafluoro ethylene polymer particles.

The charge transport layer 16 can be formed in the same manner as in forming the charge generation layer 15. Briefly, the charge-transporting material 13, the binder resin 17, and optionally any additive as described above are dissolved or dispersed in a suitable solvent to prepare a coating liquid for forming the charge transport layer, and the coating liquid is applied on the charge generation layer 15 by spraying, bar coating, roll coating, blade coating, ring coating, dip coating or the like. Again, dip coating is preferred for forming the charge transport layer 16, due to the superiority in the various points of view as described.

Examples of such solvents that may be used in the charge transport layer coating liquid include, but are not limited to, aromatic hydrocarbons such as benzene, toluene, xylene and monochlorobenzene; halogenized hydrocarbons such as dichloromethane and dichloroethane; ethers such as THF, dioxane and dimethoxymethyl ether; and aprotic polar solvents such as N,N-dimethylformamide. A solvent may be used alone, or a mixture of two or more solvents may be used. To the aforesaid solvent, a solvent such as alcohols, acetonitrile or methylethylketon may be added.

The thickness of the charge transport layer 16 is preferably from 5 μm to 50 μm, more preferably from 10 μm to 40 μm. If the thickness of the layer 16 is smaller than 5 μm, the charge-retaining ability of the photoconductor surface may decrease. If the thickness of the layer 16 is larger than 50 μm, the resolution of the photoconductor 1 may decrease.

A layer of the photosensitive layer 14, i.e., the charge generation layer 15 and/or the charge transport layer 16, may contain one or more electron acceptor materials and sensitizers such as dyes so far as the preferable properties of the photoconductor according to the present invention are not deteriorated. The use of the sensitizer can increase the sensitivity, and inhibit the residual potential increase and the fatigue due to repeated use, thereby improving the electrical durability, of the photoconductor.

Examples of the electron acceptor materials include, but are not limited to, acid anhydrides such as succinic anhydride, maleic anhydride, phthalic anhydride and 4-chloronaphthalic anhydride; cyano compounds such as tetracyanoethylene and terephthalmalondinitrile; aldehydes such as 4-nitrobenzaldehyde; anthraquinones such as anthraquinone and 1-nitroanthraquinone; polycyclic or heterocyclic nitro compounds such as 2,4,7-trinitrofluorenone and 2,4,5,7-tetranitrofluorenone; and electron-attracting materials such as diphenoquinone compounds, and polymers of the electron-attracting materials.

Examples of the sensitizers include, but are not limited to, xanthene dyes, thiazine dyes, triphenylmethane dyes, quinoline pigments, and organic photoconductive compounds such as copper phthalocyanine. The organic photoconductive compounds can act as a photosensitizer.

In the present embodiment, the photosensitive layer 14 has a multi-layered structure consisting of the charge generation layer 15 and the charge transport layer 16, both being formed as described above.

According to this embodiment, since the charge generation function and the charge-transport function are respectively served by the different layers, the optimal charge-generating material and the optimal charge-transporting material can be selected independently. Therefore, the electrophotographic photoconductor 1 can be provided to be superior in the electrical properties such as chargeability, sensitivity and photoresponsiveness, and in the electrical and mechanical durability.

Figure 2:
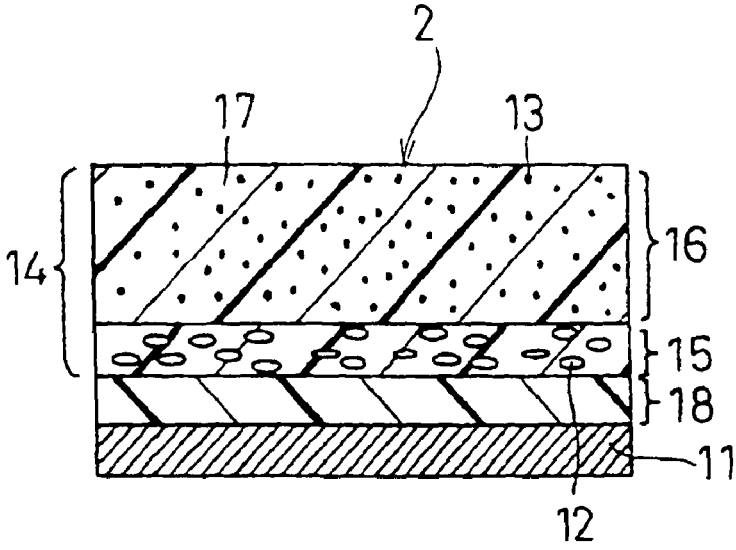
FIG. 2 is a partially sectional view illustrating schematically a photoconductor 2, another embodiment of the photoconductor according to the invention.

FIG. 2 is a partially sectional view illustrating schematically an electrophotographic photoconductor 2, another embodiment of the photoconductor according to the present invention. The photoconductor 2 is the same as the photoconductor 1 shown in FIG. 1, except that the photoconductor 2 has an interlayer 18 between the electroconductive substrate 11 and the photosensitive layer 14. Accordingly, each of the corresponding elements is referred to by the same numeral as in FIG. 1 and the description thereof is omitted herein.

In the case where the interlayer 18 is not provided between the substrate 11 and the photosensitive layer 14, charges may be injected from the substrate 11 to the photosensitive layer 14 and thus the chargeability of the layer 14 may decrease, which may cause the surface charge decrease in the surface portions not exposed to light. As a result, image defects may occur, including image fogging. In particular, in a reverse development process wherein a toner image is formed by toners adhering onto the surface portions in which the charges have been erased by the exposure to light, if the surface charges are decreased by any other reasons than the exposure to light, unwanted black dots are likely to be formed in the area to be white on a recording medium, leading to image fogging. As a result, the image quality may be significantly deteriorated.

In the photoconductor 2, the interlayer 18 is provided between the electroconductive substrate 11 and the photosensitive layer 14 as described above, thereby inhibiting the injection of charges from the substrate 11 to the layer 14. Therefore, in the photoconductor 2, the photosensitive layer 14 can be prevented from decreasing in the chargeability, and thus the surface charge decrease can be inhibited in the surface portions not exposed to light. As a result, in images formed by using the photoconductor 2, the occurrence of defects such as fogging decreases.

In addition, the interlayer 18 can bury the surface defects of the electroconductive substrate 11 and thus provide thereon a uniform surface, which allows good film formation of the photosensitive layer 14. Further, the interlayer 18 can act as an adhesive for the adhesion of the photosensitive layer 14 to the electroconductive substrate 11 and therefore inhibit delamination of the layer 14 from the substrate 11.

In a conventional photoconductor, if the interlayer 18 is provided between the electroconductive substrate 11 and the photosensitive layer 14, the sensitivity is likely to decrease. In the photoconductor 2, however, the interlayer can be provided without decreasing the sensitivity. This is because in the photosensitive layer 14, the charge-transporting material comprises the compound according to the present invention that has superior charge-transportability.

The interlayer 18 may be a resin layer of any resin material, an alumite layer, or the like.

Examples of the resin materials that may be used for forming such a resin layer include, but are not limited to, synthetic resins such as polyethylene resins, polypropylene resins, polystyrene resins, acrylic resins, polyvinyl chloride resins, polyvinyl acetate resins, polyurethane resins, epoxy resins, polyester resins, melamine resins, silicone resins, polyvinyl butyral resins and polyamide resins; copolymers comprising two or more of the repeating units constituting the aforesaid polymers; casein; gelatin; polyvinyl alcohols; and ethyl celluloses.

Out of them, preferred are polyamide resins, especially preferred alcohol-soluble nylon resins. Examples of the preferred alcohol-soluble nylon resins include, but are not limited to, so-called copolymer nylon resins, which are copolymers of, for example, 6-nylon, 6,6-nylon, 6,10-nylon, 11-nylon and/or 12-nylon; and chemically-modified nylon resins such as N-alkoxymethyl-modified nylon and N-alkoxyethyl-modified nylon.

The interlayer 18 may contain particles of metal oxide or the like. Such particles can adjust the volume resistivity in the interlayer 18, and enhance the effect of the interlayer 18 to prevent the injection of charges from the electroconductive substrate 11 to the photosensitive layer 14. In addition, the particles contained in the interlayer 18 can help the maintenance of the electrical properties of the photoconductor 2 under various environments, and thus enhance the environmental stability. Examples of the metal oxide particles that may be contained in the interlayer 18 include, but are not limited to, particles of titanium oxide, aluminum oxide, aluminum hydroxide, tin oxide, and the like.

The interlayer 18 can be formed, for example, as follows: one or more of the aforesaid resins are dissolved or dispersed in a suitable solvent to prepare a coating liquid for forming the interlayer, which is then applied onto the surface of the electroconductive substrate 11. For forming the interlayer 18 containing the metal oxide particles as described above, the interlayer coating liquid is prepared by, for example, dissolving one or more of the aforesaid resins in a suitable solvent and dispersing the metal oxide particles in the obtained resin solution, and then is applied onto the surface of the substrate 11.

Examples of the solvents that may be used in the interlayer coating liquid include, but are not limited to, water, various organic solvents, and mixture thereof. It is preferable to use, as a sole solvent, water, methanol, ethanol, butanol, or the like. It is also preferable to use, as a solvent mixture, a combination of water and an alcohol; two or more alcohols; acetone, dioxolane or the like and an alcohol; a chlorine-containing solvent such as dichloroethane, chloroform and trichloroethane and an alcohol; or the like.

Dispersion of the metal oxide particles in the resin solution can be carried out by any of the dispersion methods known in the art, such as those with the use of a ball mill, a sand mill, an attritor, a shaking mill, an ultrasonic disperser, a paint shaker, or the like.

The weight ratio (C/D) of the total of the resin and the metal oxide used (C) to the solvent used (D) in the interlayer coating liquid preferably ranges from 1/99 to 40/60, more preferably from 2/98 to 30/70.

The weight ratio (E/F) of the resin (E) to the metal oxide (F) preferably ranges from 90/10 to 1/99, more preferably from 70/30 to 5/95.

Application of the interlayer coating liquid can be conducted by spraying, bar coating, roll coating, blade coating, ring coating, dip coating, or the like. Again, dip coating is especially preferred for forming the interlayer due to the relative simpleness and the superiority in the productivity and the production costs, as described above.

The thickness of the interlayer 18 preferably ranges from 0.01 μm to 20 μm, more preferably from 0.05 μm to 10 μm. When the thickness is smaller than 0.01 μm, it may be possible that the layer 18 does not substantially function as an interlayer, i.e., the layer 18 cannot bury the surface defects of the electroconductive substrate 11 to provide a uniform surface thereon, or it cannot inhibit decrease in the chargeability of the photosensitive layer 14 by preventing the injection of the charges from the substrate 11 into the layer 14.

It is not preferable that the interlayer 18 is thicker than 20 μm, since in such a case, it is difficult to make such a thicker layer by dip coating and form thereon the photosensitive layer 14 uniformly, and as a result, the sensitivity of the photoconductor 2 is likely to be reduced.

In the present embodiment, the charge transport layer 16 may contain any optional additive such as a plasticizer, a leveling agent, and/or fine particles of inorganic and/or organic compounds, as in the previous embodiment. In addition, the charge generation layer 15 and/or the charge transport layer 16 of the photosensitive layer 14 may contain an additive such as an electron-acceptor material, a sensitizer (e.g., dye), an antioxidant, and/or an ultraviolet absorber.

Figure 3:
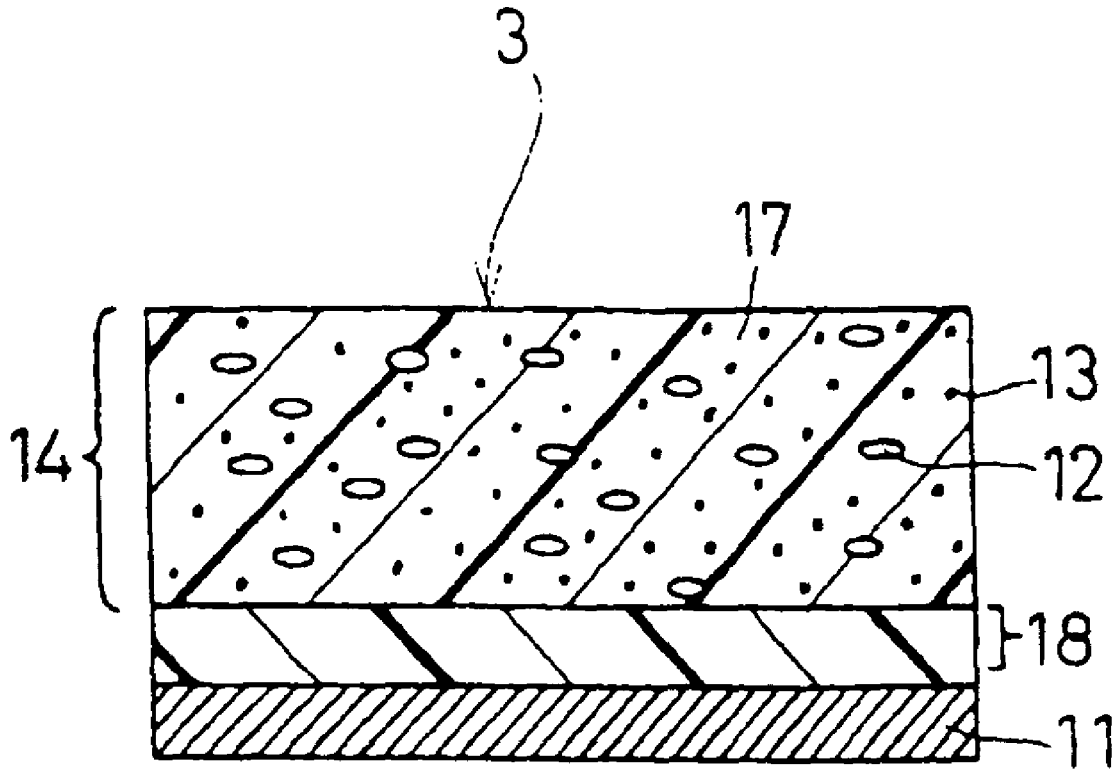
FIG. 3 is a partially sectional view illustrating schematically a photoconductor 3, still another embodiment of the photoconductor according to the invention.

FIG. 3 is a partially sectional view illustrating schematically a photoconductor 3, still another embodiment of the electrophotographic photoconductor according to the present invention. The electrophotographic photoconductor 3 is the same as the photoconductor 2 shown in FIG. 2, except that the photoconductor 3 is a single-layer photoconductor wherein the photosensitive layer 14 consists of a single layer that contains both of the charge-generating material and charge-transporting material. Accordingly, each of the corresponding elements is referred to by the same numeral as in FIG. 2 and the description thereof is omitted herein.

The single-layer photoconductor 3 of the present embodiment is preferable to be used as a positively-charged photoconductor, which is used with less ozone generation. In addition, since photosensitive layer 14 is formed as a single layer, the photoconductor 3 is superior in the production costs and the yield rate to the multi-layer photoconductors 1 and 2.

The photosensitive layer 14 can be formed by binding the charge-transporting material as represented by the general formula (1), in particular, the compound as represented by the general formula (2) or (3), optionally a charge-transporting material other than the compounds represented by the general formula (1), and the charge-generating material as described above with a binder resin. As the binder resin for the single layer photosensitive layer 14 of the present embodiment, any of the binder resins described above for forming the charge transport layer 13 of the photoconductor 1 may be used.

The photosensitive layer 14 may contain any optional additive such as a plasticizer, a leveling agent, fine particles of inorganic and/or organic compounds, an electron-acceptor material, a sensitizer (e.g., a dye), an antioxidant, and/or an ultraviolet absorber, as in the photosensitive layer 14 of the photoconductor 1.

The photosensitive layer 14 can be formed in the same manner as the charge transport layer 16 of the photoconductor 1. For example, appropriate amounts of the charge-generating material as described above, the charge-transporting material as represented by the general formula (1), and the binder resin, and optionally a charge-transporting material other than the compounds represented by the general formula (1) and an optional additive are dissolved or dispersed in such a suitable solvent as described above for forming the charge transport layer of the photoconductor 1 to prepare a photosensitive layer coating liquid, which is then applied onto the interlayer 18 by dip coating to form the photosensitive layer 14.

The weight ratio (B'/A') of the binder resin (B') to the charge-transporting material (A') in the photosensitive layer 14 preferably ranges from 1.2 to 3.0, like the weight ratio B/A of the binder resin (B) to the charge-transporting material (A) in the charge transport layer 16 of the photoconductor 1. The amount of the charge-generating material in the photosensitive layer 14 preferably ranges from 1.5 to 10% by weight with respect to the total weight of the layer 14.

The thickness of the photosensitive layer 14 preferably ranges from 5 μm to 100 μm, more preferably from 10 μm to 50 μm. When the thickness is smaller than 5 μm, the charge-retaining ability of the photoconductor surface may be decreased. When the thickness is larger than 100 μm, the productivity may be reduced.

The electrophotographic photoconductor 3 of the present embodiment may contain a higher proportion of the binder resin in the photosensitive layer 14 since the high charge-transportability compound as represented by the general formula (1) is used as the charge-transporting material. Therefore, the photoconductor 3 can be improved in the printing durability of the layer 14 without reducing the photoresponsiveness and in the mechanical durability of the photoconductor.

It is to be understood that the electrophotographic photoconductors according to the present invention should not be limited to the photoconductors 1, 2 and 3 as described above, and may be provided in any other configurations or arrangements so long as the charge-transporting material in the photosensitive layer comprises the compound as represented by the general formula (1).

For example, a protective layer may be provided on the surface of the photosensitive layer 14 in any of the photoconductors 1 to 3. The protective layer can improve the mechanical durability of the photoconductor. The protective layer can also prevent chemically adverse effects, on the photosensitive layer, of active gases generated by corona charging, such as ozone and/or nitrogen oxide ($NO_x$), and therefore improve the electrical durability of the photoconductor. The protective layer may be, for example, a layer comprised of a resin, an inorganic filler-containing resin, inorganic oxide and/or the like.

Here is described an image-forming apparatus provided with an electrophotographic photoconductor according to the present invention.

Figure 4:
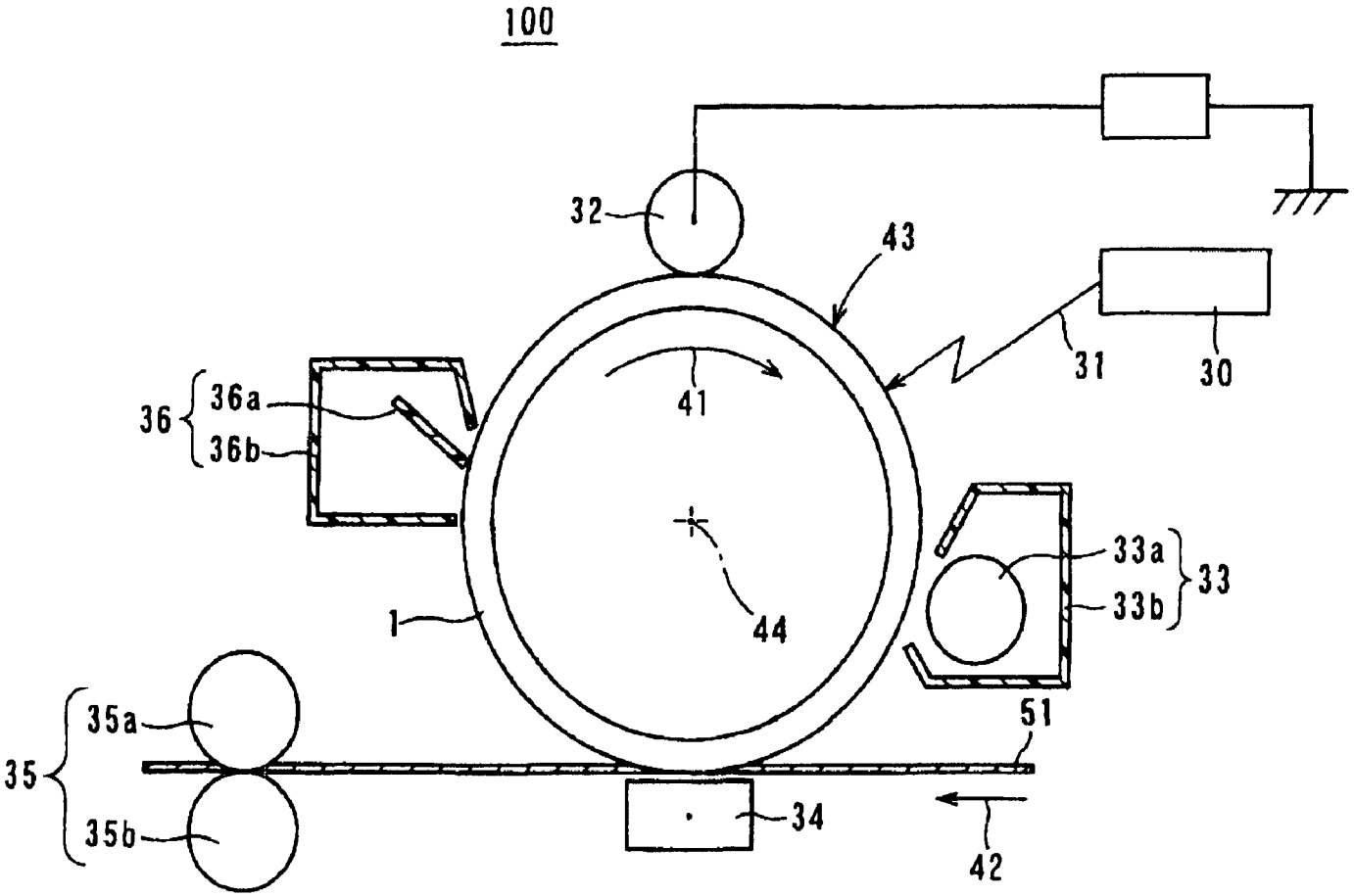
FIG. 4 is a sectional view illustrating schematically an image-forming apparatus 100, one embodiment of the image-forming apparatus according to the invention.

FIG. 4 is a sectional view illustrating schematically an image-forming apparatus 100, one embodiment of the image-forming apparatus according to the invention. The image-forming apparatus 100 is provided with the photoconductor 1, one embodiment of the electrophotographic photoconductor according to the present invention. By referring to FIG. 4, the configuration and the mode of operation of the image-forming apparatus 100 will be described below.

The image-forming apparatus 100 comprises the photoconductor 1, which is freely-rotatably mounted on the apparatus body (not shown), and a driving means (not shown) for driving the rotation of the photoconductor 1 on the rotational axis 44 in the direction indicated by an arrow 41. The driving means comprises a source of power such as a motor, the power from which is transmitted via a gear to the core, or the substrate, of the photoconductor 1, thereby rotating the photoconductor 1 at a given peripheral velocity $V_p$.

Along the circumferential surface of the photoconductor 1, a charger unit 32, a light exposure unit 30, a developer unit 33, an image transfer unit 34 and a cleaner unit 36 are provided in this order in the rotational direction of the photoconductor 1 indicated by the arrow 41.

The charger unit 32 is a means for charging the surface 43 of the photoconductor 1 at a given potential. The charger unit 32 is shown as a contact charger such as a roller charger in FIG. 4, although it may be a non-contact charger such as a corona charger (e.g., scorotron charger).

The light exposure unit 30 comprises a source of light such as a semiconductor laser, which emits light 31 such as laser beam according to the image information, as scanning the charged surface 43 of the photoconductor 1. In the portions of the surface 43 exposed to the light, the surface charge is erased. Thus, an electrostatic latent image corresponding to the image information is formed on the surface 43.

The developer unit 33 is a means for developing the electrostatic latent image formed on the surface 43 with a developing agent (a toner, for example) to form a visible toner image. It is provided so as to face the photoconductor 1. The developer unit 33 may comprise a developer roller 33*a*, which supplies the developing agent onto the surface 43, and a casing 33*b*, which supports the developer roller 33*a* so as to be rotatable on such a rotational axis that is parallel to the rotational axis 44 of the photoconductor 1 and which contains the developing agent.

The image transfer unit 34 is a means for transferring the toner image formed on the surface 43 onto a recording paper 51, or a transfer medium. In FIG. 4, the image transfer unit 34 is shown as a non-contact image transfer means which has a charger, such as corona charger, to charge the recording paper 51 oppositely to the toner, thereby transferring the toner image onto the recording paper 51. However, the unit 34 may be a contact image transfer means using pressure. The contact image transfer means may comprise a transfer roller or the like, which presses the recording paper 51 onto the surface 43 of the photoconductor 1. In this case, while the paper 51 is in contact with the surface 43, an electric voltage is applied to the roller so as to transfer the toner image from the surface 43 onto the recording paper 51.

The cleaner unit 36 is a means for cleaning the surface of the photoconductor 1 after the image transfer. The cleaner unit 36 may comprise a cleaning blade 36*a*, which is pressed against the surface 43 so as to scrape off the remaining toner on the surface 43 after the image transfer, and a collection casing 36*b*, which stores the toner scraped off by the blade 36*a*.

The cleaner unit 36 may be provided together with a discharger not shown in the figure. The discharger is a means for removing the residual charges on the surface of the photoconductor 1. The discharger may be a discharge lamp.

A fixing unit 35 is provided downstream from the image transfer unit 34 along the path of the recording paper 51. The fixing unit 35 is a mean for fixing the transferred image onto the recording paper. The fixing unit 35 may comprise a heating roller 35*a*, which has a heating means (not shown), and a pressing roller 35*b*, which is provided so as to face the heating roller 35*a* and can be pressed against the heating roller 35*a*.

The mode of operation of the image-forming apparatus 100 is described below.

The photoconductor 1 is rotated by the driving means (not shown) in the direction indicated by the arrow 41, according to an instruction from a control unit (not shown). As it rotates, the surface 43 is uniformly charged at a predetermined positive or negative potential by the charger 32, which is provided so as to face the surface 43 upstream of a circumferential location where the light 31 is focused on in the rotational direction of the photoconductor 1.

The light 31 is emitted from the exposure unit 30 to the charged surface 43, according to the instruction from the control unit. The light 31 scans across the surface 43 in the longitudinal direction, that is, the main scanning direction, according to the image information. The scanning is repeated as the photoconductor 1 rotates, and therefore the surface 43 is exposed to the light 31 according to the image information. The charge in the exposed portions of the surface is reduced. This results in a difference in the surface potential between the exposed portions and the unexposed portions, and thereby forming an electrostatic latent image on the surface 43 of the photoconductor 1.

Synchronously with the light exposure of the photoconductor 1, the recording paper 51 is forwarded by a transporting means in the direction indicated by an arrow 42 so as to be fed between the image transfer unit 34 and the surface 43 of the photoconductor 1.

The toner is supplied onto the surface 43 by the developer roller 33*a* of the image developer unit 33, which is provided so as to face the surface 43 downstream of the circumferential location where the light 31 is focused on in the rotational direction of the photoconductor 1. The toner develops the electrostatic latent image into a visible toner image on the surface 43. When being fed between the image transfer unit 34 and the surface 43, the recording paper 51 is charged oppositely to the toner by the transfer unit 34, and thereby transferring the toner image from the surface 43 onto the paper 51.

The recording paper 51, onto which the toner image has been transferred, is forwarded to the fixing unit 35 by the transporting means, and is heated and pressed between the heating roller 35*a* and the pressing roller 35*b* of the fixing unit 35. This allows the toner image to be fixed onto the recording paper 51. Then, the recording paper 51 is further forwarded by the transporting means so as to be discharged outside from the image-forming apparatus 100.

As the photoconductor 1 further rotates in the direction indicated by the arrow 41 after the toner image is transferred onto the recording paper 51, the cleaning blade 36*a* of the cleaner unit 36 scrapes and cleans the surface 43. Thus, the residual toner on the surface 43 is removed. Then, the light from the discharge lamp erases the charge on the surface 43, thereby eliminating the electrostatic latent image on the surface 43 of the photoconductor 1.

As forced to further rotate, the photoconductor 1 is again charged and then the above sequence of operation is repeated. As described above, images are formed successively.

In the electrophotographic photoconductor 1 of the image-forming apparatus 100, the photosensitive layer 14 contains the compound as represented by the general formula (1) of the present invention as a charge-transporting material, and therefore the photoconductor 1 is superior in electrical properties such as chargeability, sensitivity and photoresponsiveness; electrical and mechanical durability; and environmental stability. As a result, the image-forming apparatus 100 is a highly reliable apparatus that is capable of stably forming high quality images for a long term under various environments.

In addition, even when the photoconductor 1 is used in a high-speed electrophotographic process, the quality of the formed image is not deteriorated. Therefore, the image-forming apparatus 100 can be operated at a higher image-forming speed. For example, it is possible to form high quality images, even when the photoconductor 1 having a diameter of 30 mm and a longitudinal length of 340 mm is used in a high-speed process at a peripheral velocity ($V_p$) of the photoconductor 1 of about 100 to 140 mm/sec, and when the image-forming apparatus 100 is operated at a high image-forming speed of 25 sheets of A4 paper according to JIS P0138 per minute.

It should be noted that the image-forming apparatus according to the present invention is not limited to the configuration or the arrangement as described above by referring to FIG. 4, and may be provided in any configurations and/or arrangements, so far as it comprises the photoconductor according to the present invention.

EXAMPLES

The invention will now be described in detail with reference to the following examples, which are intended to illustrate and not to limit the scope of the present invention.

Production Example 1

Productions of Exemplified Compound No. 1

From N,N'-diphenylbenzidine and diphenylacetaldehyde, an enamine compound represented by the following formula (7) was synthesized according to the method described in Japanese Patent Publication No. Hei 6 (1994)-348045-A, the disclosure of which is incorporated herein in its entirety by reference for any and all purposes:

(7)

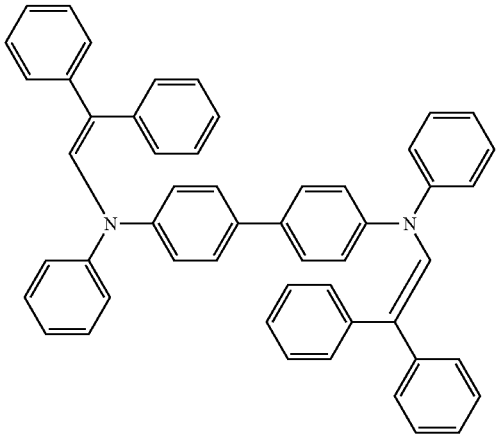

Phosphorus oxychloride in an amount of 5.52 g (1.2 mole equivalents) was gradually added to 100 ml of ice-cold anhydrous N,N-dimethylformamide (DMF) and stirred for about 30 minutes to prepare a Vilsmeier reagent. To the ice-cold Vilsmeier reagent, 20.79 g (1.0 mole equivalent) of the enamine compound was gradually added. Then, the mixture was gradually heated up to 80° C., and stirred for 6 hours while kept at 80-90° C. After completion of the reaction, the mixture was left to cool, and then gradually added to 800 ml of a cold 4 N aqueous sodium hydroxide solution to precipitate the reaction product. The precipitated product was filtered off, well washed with water, and then re-crystallized in a solvent mixture of ethanol and ethyl acetate to obtain 18.0 g of a yellow powder.

The obtained crystals were analyzed by Liquid Chromatography-Mass Spectrometry (LC-MS), and a peak was observed at a position corresponding to a molecular weight (MW) of 748.9, which is very close to that of the molecular ion $[M]^+$ of the intended aldehyde compound represented by the following formula (8) having a theoretical MW of 748.31:

(8)

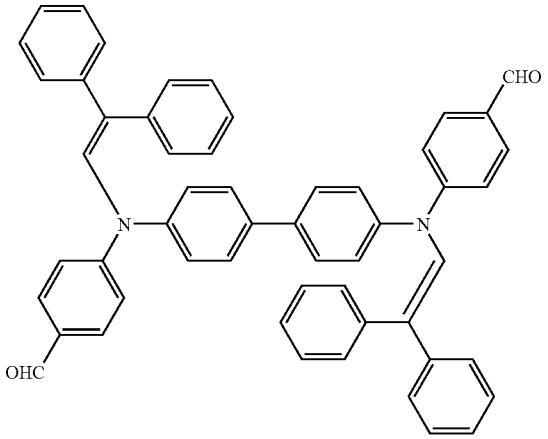

This confirmed the obtained compound was the aldehyde compound represented by the formula (8) (yield: 80%). In addition, the LC-MS data revealed that the purity of the obtained aldehyde compound was 98.7%.

Then, 7.49 g (1.0 mole equivalent) of the obtained aldehyde compound and 3.05 g (1.2 mole equivalents) of a Wittig reagent represented by the following formula (9) were dissolved in 80 mL of anhydrous DMF. To the mixture, 1.40 g (1.25 mole equivalents) of potassium t-butoxide was gradually added with cooing the mixture at 0° C.

(9)

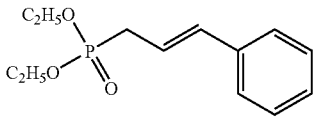

After stirring for 1 hour at a room temperature, the reaction mixture was heated to 40° C., and was further stirred for 7 hours while kept at 40° C. The reaction mixture was stood to cool, and then poured into an excess of methanol. The resulting precipitate was filtered off, and dissolved into toluene. This toluene solution was washed with water in a separating funnel, and the organic phase was removed and dried over magnesium sulphate. The organic phase was then filtered so that the solid matters were removed. The filtrate was concentrated, and subjected to silica gel column chromatography to obtain a yellow crystal (7.59 g).

The thus obtained crystal was analyzed by LC-MS, and a peak was observed at a position corresponding to an MW of 948.9, which is very close to that of the molecular ion $[M]^+$ of the intended compound, Exemplified Compound No. 1 shown in Table 1 below, having a theoretical MW of 948.44. In addition, some other peaks, which are due to the fragment ions, were observed at positions corresponding to the MWs close to the following:

the theoretical MW of 871 of the fragment ion $[M-\phi]^+$, wherein a benzene ring is eliminated;

the theoretical MW of 819 of the fragment ion $[M-(\phi-CH{=}CH{-}CH{=}CH)]^+$, wherein a phenyl butadiene is eliminated;

the theoretical MW of 769 of the fragment ion $[M-(CH{=}C(\phi)_2)]^+$, wherein an enamine unit is eliminated;

the theoretical MW of 743 of the fragment ion $[M-(\phi-CH{=}CH{-}CH{=}CH-\phi)]^+$, wherein a diphenyl butadiene is eliminated;

the theoretical MW of 550 of the fragment ion $[M-(\phi-CH{=}CH{-}CH{=}CH-\phi(-\phi)-N{-}CH{=}C(\phi)_2)]^+$, wherein an amine unit is eliminated; and the theoretical MW of 474 of the fragment ion $[M-(\phi-CH{=}CH{-}CH{=}CH-\phi(-\phi)-N{-}CH{=}C(\phi)_2)]^+$, that is, a divided half form.

In the above formulae, $\phi$ represents a benzene ring.

This confirmed that the obtained crystal was Exemplified Compound No. 1 (yield: 80%). In addition, the LC-MS data revealed that the purity of the obtained compound was 99.0%.

The element analysis was conducted on the obtained compound simultaneously for carbon (C), hydrogen (H) and nitrogen (N) by differential thermal conductivity method (the same is true for the other examples described below). The element analysis data of the compound obtained above and the theoretical values of Exemplified Compound No. 1 are indicated below:

Measured: C, 91.21%; H, 5.80%; N, 2.99%

Theoretical: C, 91.10%; H, 5.95%; N, 2.95%.

Production Example 2

Production of Exemplified Compound No. 24

From N,N'-dinaphtyl-3,3'-dimethylbenzidine and diphenylacetaldehyde, an enamine compound represented by the following formula (10) was synthesized according to the method described in Japanese Patent Publication No. Hei 6 (1994)-348045-A:

(10)

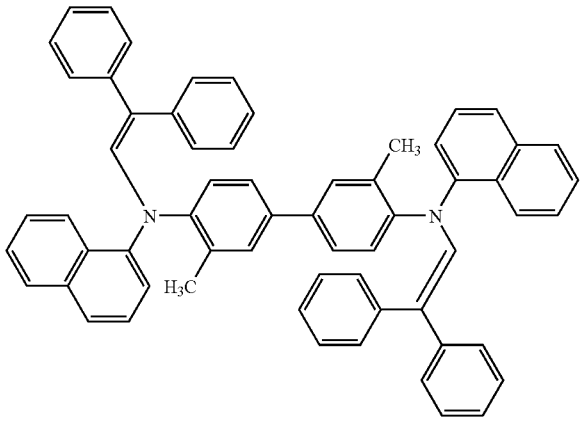

Starting from the enamine compound, an aldehyde compound was prepared as described in Production Example 1. The thus obtained aldehyde compound was subjected to LC-MS and element analyses. The analysis data (see below) confirmed that the obtained compound was Exemplified Compound No. 24.

LC-MS analysis data:

Purity: 99.2%

A peak observed at a position corresponding to an MW of 1084.9

(Theoretical MW of the molecular ion $[M]^+$ of Exemplified Compound No. 24: 1084.50)

Peaks due to the fragment ions observed at positions corresponding to the MWs close to following:

the theoretical MW of 1069 of the fragment ion $[M-Me]^+$, wherein a methyl group is eliminated;

the theoretical MW of 1054 of the fragment ion $[M-(Me)_2]^+$, wherein two methyl groups are eliminated;

the theoretical MW of 977 of the fragment ion $[M-\phi-OMe]^+$, wherein an anisyl group is eliminated;

the theoretical MW of 951 of the fragment ion $[M-(MeO-\phi-CH{=}CH)]^+$, wherein a methoxystyryl group is eliminated;

the theoretical MW of 905 of the fragment ion $[M-(CH{=}C(\phi)_2)]^+$, wherein an enamine unit is eliminated;

the theoretical MW of 825 of the fragment ion $[M-(MeO-\phi-CH{=}CH-Np)]^+$, wherein a stilbene unit is eliminated;

the theoretical MW of 632 of the fragment ion $[M-(MeO-\phi-CH{=}CH{-}Np{-}N{-}CH{=}C(\phi)_2)]^+$, wherein an amine unit is eliminated; and the theoretical MW of 542 of the fragment ion $[M-(MeO-\phi-CH{=}CH{-}Np(-\phi-Me)-N{-}CH{=}C(\phi)_2)]^+$, that is, a divided half form.

In the above formulae, $\phi$ represents a benzene ring, Np represents a naphthalene group, and Me represents a methyl group.

Element analysis data of the obtained compound and the theoretical value of Exemplified Compound No. 24:

Measured: C, 88.48%; H, 6.01%; N, 2.51%

Theoretical: C, 88.53%; H, 5.94%; N, 2.58%.

Production Example 3

Production of Exemplified compound No. 3

From 1-(4-phenylaminophenyl)-4-phenylaminobenzofuran and diphenylacetaldehyde, an enamine compound represented by the following formula (11) was synthesized according to the method described in Japanese Patent Publication No. Hei 6 (1994)-348045-A:

(11)

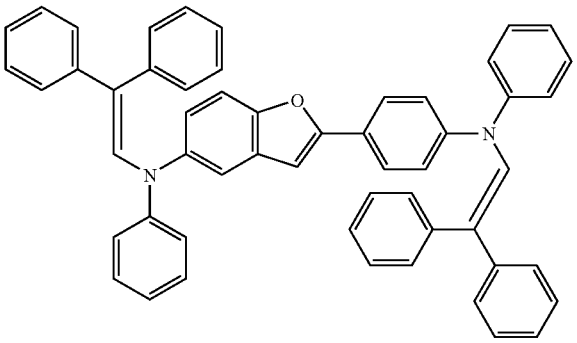

Starting from the enamine compound, an aldehyde compound was prepared as described in Production Example 1. The thus obtained aldehyde compound was subjected to LC- MS and element analyses. The analysis data (see below) confirmed that the obtained compound was Exemplified compound No. 30.

LC-MS analysis data:

Purity: 98.7%

A peak observed at a position corresponding to an MW of 988.9

(Theoretical MW of the molecular ion $[M]^+$ of Exemplified Compound No. 30: 988.44)

Peaks due to the fragment ions observed at positions corresponding to the MWs close to the following:

the theoretical MW of 911 of the fragment ion $[M-\phi]^+$, wherein a benzene ring is eliminated;

the theoretical MW of 859 of the fragment ion $[M-(\phi-CH{=}CH{-}CH{=}CH)]^+$, wherein a phenyl butadiene is eliminated;

the theoretical MW of 809 of the fragment ion $[M-(CH{=}C(\phi)_2)]^+$, wherein an enamine unit is eliminated;

the theoretical MW of 783 of the fragment ion $[M-(\phi-CH{=}CH{-}CH{=}CH-\phi)]^+$, wherein a diphenyl butadiene is eliminated;

the theoretical MW of 590 of the fragment ion $[M-(\phi-CH{=}CH{-}CH{=}CH-\phi-N{-}CH{=}C(\phi)_2)]^+$, wherein an amine unit is eliminated; and the theoretical MW of 514 or 474 of the fragment ion $[M-(\phi-CH{=}CH{-}CH{=}CH-\phi(-\phi)-N{-}CH{=}C(\phi)_2)]^+$, that is, a divided half form.

In the above formulae, $\phi$ represents a benzene ring).

Element analysis data of the obtained compound and the theoretical value of Exemplified Compound No. 30:

Measured: C, 89.75%; H, 5.80%; N, 2.79%

Theoretical: C, 89.85%, H, 5.71%; N, 2.83%.

Production Example 4

Exemplified Compound No. 45

From 3,6-phenylamino-N-ethylcarbazole and diphenylacetaldehyde, an enamine compound represented by the following formula (12) was synthesized according to the method described in Japanese Patent Publication No. Hei 6 (1994)-348045-A:

(12)

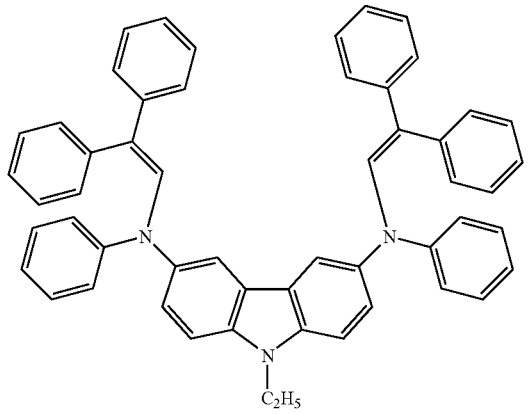

Starting from the enamine compound, an aldehyde compound was prepared as described in Production Example 1. The thus obtained aldehyde compound was subjected to LC-MS and element analyses. The analysis data (see below) confirmed that the obtained compound was Exemplified Compound No. 45.

LC-MS analysis data:

Purity: 98.7%

A peak observed at a position corresponding to MW of 990.9

(Theoretical MW of the molecular ion $[M+H]^+$ of Exemplified Compound No. 45: 989.47)

Peaks due to the fragment ions observed at positions corresponding to the MWs close to the following:

the theoretical MW of 974 of the fragment ion $[M-Me]^+$, wherein a methyl group is eliminated;

the theoretical MW of 960 of the fragment ion $[M-CH_2CH_3)]^+$, wherein an ethyl group is eliminated;

the theoretical MW of 912 of the fragment ion $[M-\phi]^+$, wherein a benzene ring is eliminated;

the theoretical MW of 860 of the fragment ion $[M-(\phi-CH{=}CH{-}CH{=}CH)]^+$, wherein a phenyl butadiene is eliminated;

the theoretical MW of 810 of the fragment ion $[M-(CH{=}C(\phi)_2)]^+$, wherein an enamine unit is eliminated;

the theoretical MW of 784 of the fragment ion $[M-(\phi-CH{=}CH{-}CH{=}CH-\phi)]^+$, wherein a diphenyl butadiene is eliminated; and the theoretical MW of 591 of the fragment ion $[M-(\phi-CH{=}CH{-}CH{=}CH-\phi-N{-}CH{=}C(\phi)_2)]^+$, wherein an amine unit is eliminated.

In the above formulae, $\phi$ represents a benzene ring and Me represents a methyl group.

Element analysis data of the compound obtained and the theoretical value of Exemplified Compound No. 45:

Measured: C, 89.68%; H, 6.03%; N, 4.29%

Theoretical: C, 89.75%; H, 6.01%; N, 4.24%.

Example 1

Nine parts by weight of dendritic particles of titanium oxide (TTO-D-1; Ishihara Sangyo Kaisha, Ltd., Osaka, Japan), which had been surface-treated with aluminum oxide ($Al_2O_3$) and zirconium dioxide ($ZrO_2$), and 9 parts by weight of a copolymer nylon resin (CM8000; Toray Industries, Inc., Tokyo, Japan) were dissolved and dispersed in a solvent mixture of 41 parts by weigh of 1,3-dioxolane and 41 parts by weight of methanol by using a paint shaker for 12 hours, to prepare an interlayer coating liquid. This coating liquid was applied onto an electroconductive substrate of 0.2 mm-thick aluminium plate with a Baker's applicator, and dried to form thereon an interlayer of 1 μm thick.

Then, in a resin solution of 1 part by weight of a polyvinyl butyral resin (BX-1; Sekisui Chemical Co., Ltd., Osaka, Japan) in 97 parts by weight of THF, 2 parts by weight of an X-form metal-free phthalocyanine as a charge-generating material was dispersed by using a paint shaker for 10 hours to prepare a charge generation layer coating liquid. This coating liquid was applied onto the interlayer formed as described above with a Baker's applicator, and dried to form thereon a charge generation layer of 0.3 μm thick.

Next, 10 parts by weight of Exemplified Compound No. 1 shown in Table 1 as a charge-transporting material, 18 parts by weight of a polycarbonate resin (Z200; Mitsubishi Gas Chemical Company, Inc., Tokyo, Japan) as a binder resin, and 0.2 parts by weight of 2,6-di-t-butyl-4-methylphenol were dissolved in 115 parts by weight of THF to prepare a charge transport layer coating liquid. This coating liquid was applied onto the charge generation layer formed as described above with a Baker's applicator, and dried to form thereon a charge transport layer of 20 μm thick.

Thus, the electrophotographic photoconductor of Example 1 was prepared, which has a multi-layered structure as illustrated in FIG. 2.

Examples 2 and 3

The photoconductors of Examples 2 and 3 were prepared according to the method as described in Example 1, except that Exemplified Compound Nos. 24 and 30 respectively were used, in place of Exemplified Compound No. 1, as a charge-transporting material.

Comparative Example 1

The photoconductor of Comparative Example 1 was prepared according to the method as described in Example 1, except that Comparative Compound A (a triphenylamine dimer; TPD) represented by the following formula (13) was used, in place of Exemplified compound No. 1, as a charge-transporting material.

(13)

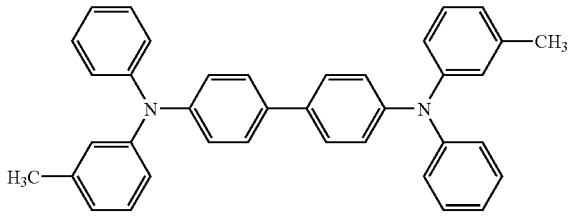

Example 4

As described in Example 1, an interlayer of 1 μm thick was formed on an electroconductive substrate of 0.2 mm-thick aluminium plate. Then, 1 part by weight of the X-form metal-free phthalocyanine as a charge-generating material, 18 parts by weight of a polycarbonate resin (Z-400; Mitsubishi Gas Chemical Company, Inc., Tokyo, Japan) as a binder resin, 10 parts by weight of Exemplified Compound No. 1 shown in Table 1 as a charge-transporting material, 5 parts by weight of 3,5-dimethyl-3',5'-di-t-butylphenoxone, and 0.5 parts by weight of 2,6-di-t-butyl-4-methylphenol were dissolved and dispersed in 115 parts by weight of THF by using a ball mill for 12 hours, to prepare a photosensitive layer coating liquid. This coating liquid was applied onto the interlayer formed as described above with a Baker's applicator, and dried with air blow at a temperature of 110° C. for 1 hour, to form thereon a photosensitive layer of 20 μm thick.

Thus, the electrophotographic photoconductor of Example 4 was prepared, which has a single-layer structure as illustrated in FIG. 3.

Evaluation 1

The photoconductors of Examples 1-4 and Comparative Example 1 were evaluated for the properties at the initial phase of use and after repeated use, on an electrostatic paper analyzer (EPA-8200; Kawaguchi Electric Works Co., Ltd., Tokyo, Japan). The evaluations were conducted at a temperature of 22° C. and a relative humidity of 65%, which is referred to as the normal temperature/normal humidity (N/N) environment, and at a temperature of 5° C. and a relative humidity of 20%, which is referred to as the low temperature/low humidity (L/L) environment.

The protocol for the evaluation in the initial phase was as follows: when the photoconductor surface was charged by applying a negative voltage of −5 kV to the photoconductors, the initial potential of charge $V_0$ [in V] was measured. In the case where the single-layer photoconductor of Example 4 was tested, the surface was charged by applying a positive voltage of +5 kV. The larger the absolute value of the initial potential $V_0$ was, the superior in chargeability the photoconductor was considered.

Then, as the charged surface was exposed to light, the electrical potential of charge was measured so as to determine the half decay energy $E_{1/2}$ [in μJ/cm$^2$] that is the exposed light energy required to attenuate the surface potential by half of the initial potential $V_0$. The smaller the half decay energy $E_{1/2}$ was, the superior in sensitivity the photoconductor was considered. In addition, 10 seconds after starting the light exposure, the residual surface potential $V_r$ [in V] was measured. The larger the absolute of the residual potential $V_r$ was, the superior in photoresponsiveness the photoconductor was considered. The light used for this measurement was a monochromatic light obtained via a monochrometer, having a wavelength of 780 nm and an energy of 1 μW/cm$^2$.

The protocol for the evaluation after repeated use was as follows: after 5,000 cycles of the surface charging and the light exposing as described above, the initial potential $V_0$, the half decay energy $E_{1/2}$ and the residual potential $V_r$ were measured to evaluate chargeability, sensitivity and photoresponsiveness, as described in the protocol for the evaluation in the initial phase.

The results are shown in Table 2.

TABLE 2

| | Charge-transporting | N/N Environment (22° C., 65% humidity) | | | | | | L/L Environment (5° C., 20% humidity) | | | | | |
|---|---|---|---|---|---|---|---|---|---|---|---|---|---|
| | | Initial phase | | | After repeated use | | | Initial phase | | | After repeated use | | |
| | material (Ex. Comp. No) | $E_{1/2}$ (μJ/cm$^2$) | $V_0$ (V) | $V_r$ (V) | $E_{1/2}$ (μJ/cm$^2$) | $V_0$ (V) | $V_r$ (V) | $E_{1/2}$ (μJ/cm$^2$) | $V_0$ (V) | $V_r$ (V) | $E_{1/2}$ (μJ/cm$^2$) | $V_0$ (V) | $V_r$ (V) |
| Example 1 | 1 | 0.13 | −582 | −25 | 0.18 | −578 | −29 | 0.16 | −575 | −31 | 0.20 | −571 | −35 |
| Example 2 | 24 | 0.17 | −579 | −28 | 0.20 | −570 | −39 | 0.20 | −577 | −35 | 0.23 | −567 | −45 |
| Example 3 | 30 | 0.15 | −580 | −24 | 0.18 | −575 | −31 | 0.18 | −580 | −33 | 0.21 | −570 | −39 |
| Comparative Example 1 | A* | 0.24 | −278 | −35 | 0.25 | −576 | −48 | 0.36 | −580 | −45 | 0.40 | −578 | −58 |
| Example 4 | 1 | 0.18 | 550 | 25 | 0.21 | 540 | 40 | 0.20 | 550 | 25 | 0.24 | −545 | 39 |

Note:
A* indicates Comparative Compound A.

As seen from Table 2, the photoconductors of Examples 1-4, which comprise the compounds as represented by the general formula (1) as a charge-transporting material, are superior in chargeability, sensitivity and photoresponsiveness to the photoconductor of Comparative Example 1 under both the N/N and L/L environments. In addition, even after being used repeatedly, the photoconductors of Examples 1-4 have the superior electrical properties, which are comparable with those in the initial phase of use, to the photoconductor of Comparative Example 1.

Example 5

Nine parts by weight of dendritic particles of titanium oxide (TTO-D-1; Ishihara Sangyo Kaisha, Ltd., Osaka, Japan), which had been surface-treated with aluminum oxide ($Al_2O_3$) and zirconium dioxide ($ZrO_2$), and 9 parts by weight of copolymer nylon resin (CM8000; Toray Industries, Inc., Tokyo, Japan) were dissolved and dispersed in a solvent mixture of 41 parts by weigh of 1,3-dioxolane and 41 parts by weight of methanol by using a paint shaker for 8 hours, to prepare an interlayer coating liquid. This coating liquid was poured into a tank for dip coating. An electroconductive substrate of aluminium cylinder with a diameter of 40 mm and a longitudinal length of 340 mm was dipped into and withdrawn from the coating liquid in the tank, and then dried to form thereon an interlayer of 1.0 μm thick.

Then, 2 parts by weight of such an oxotitanium phthalocyanine that presents at least a peak at the Bragg angle (2θ±0.2°) of 27.2° in the diffraction spectrum as observed with the Cu—Kα characteristic X-ray having a wavelength of 1.54 Å as a charge-generating material, and 1 part by weight of polyvinyl butyral resin (S-LEC BM-S; Sekisui Chemical Co., Ltd., Osaka, Japan) were dissolved and dispersed in 97 parts by weight of methylethyl ketone with a paint shaker to prepare a charge generation layer coating liquid. This coating liquid was applied onto the interlayer by dip coating as described above for the interlayer, and dried to form thereon a charge generation layer of 0.4 μm thick.

Next, 10 parts by weight of Exemplified Compound No. 1 shown in Table 1 as a charge-transporting material, 20 parts by weight of a polycarbonate resin (Iupilon Z200; Mitsubishi Engineering-Plastics Corporation, Tokyo, Japan) as a binder resin, 1 part by weight of 2,6-di-t-butyl-4-methylphenol and 0.004 parts by weight of dimethylpolysiloxane (KF-96; Shin-Etsu Chemical Co., Ltd., Tokyo, Japan) were dissolved in 120 parts by weight of THF, to prepare a charge transport layer coating liquid. This coating liquid was applied onto the charge generation layer by dip coating as described above for the interlayer, and dried at a temperature of 130° C. for 1 hour to form thereon a charge transport layer of 23 μM thick.

Thus, the photoconductor of Example 5 was obtained.

Examples 6 and 7

The photoconductors of Examples 6 and 7 were obtained according to the method described in Example 5, except that Exemplified Compound Nos. 30 and 45 respectively were used, in place of Exemplified Compound No. 1, as a charge-transporting material.

Comparative Example 2

The photoconductor of Comparative Example 2 was prepared according to the method described in Example 5, except that Comparative Compound A represented by the above formula (13) was used, in place of Exemplified Compound No. 1, as a charge-transporting material.

Example 8

The photoconductor of Example 8 was prepared according to the method described in Example 5, except that 25 parts by weight of the polycarbonate resin was used for forming the charge transport layer.

Examples 9 and 10

The photoconductors of Examples 9 and 10 were prepared according to the method described in Example 5, except that 25 parts by weight of the polycarbonate resin was used for forming the charge transport layer, and Exemplified Compound Nos. 30 and 45 respectively were used, in place of Exemplified Compound No. 1, as a charge-transporting material.

Example 11

Reference Example 1

The photoconductor of Example 11 was prepared according to the method described in Example 5, except that 10 parts by weight of the polycarbonate resin was used for forming the charge transport layer.

Reference Example 2

The photoconductor of Reference Example 2 was prepared according to the method described in Example 5, except that 31 parts by weight of the polycarbonate resin was used for forming the charge transport layer. When such a large amount of the polycarbonate resin was dissolved in the same amount of THF as used in Example 5, the resulting liquid was thick. Therefore, the amount of THF was increased so as to obtain a well dilute coating liquid. This coating liquid was used for forming the charge transport layer in this Reference Example. However, the formed charge transport layer was clouded due to blushing around the longitudinal ends of the photoconductor drum. Therefore, the photoconductor of Reference Example 2 could not be evaluated according to Evaluation 2 described below. The blushing may have been caused by the presence of the excess solvent in the coating liquid.

Reference Example 3

The photoconductor of Reference Example 3 was prepared according to the method described in Example 5, except that Comparative Compound A represented by the above formula (13) was used, in place of Exemplified Compound No. 1, as a charge-transporting material, and 10 parts by weight of the polycarbonate resin was used for forming the charge transport layer.

Evaluation 2

The photoconductors of Examples 5-7 and Comparative Example 2 were measured for the hole mobility at an electric field strength of $2.5\times10^5$ V/cm, a temperature of 25° C. and a relative humidity of 50% by using a drum checker (CYNCYA; GEN-TECH, INC., Yokohama, Japan) in the X-TOF mode.

The photoconductors of Examples 5-11, Comparative Example 2 and Reference Example 3 were evaluated for the printing durability, electrical properties and environmental stability, when provided in a tester copier that was a commercially available digital copier (AR-C150; Sharp Corporation, Osaka, Japan) in which the peripheral velocity of the photoconductor was altered to 117 mm/sec. The AR-C150 digital copier is an image-forming apparatus of negative charge type, in which the photoconductor surface is negatively charged at the start of the electrophotographic image-forming process.

(a) Printing Durability

After used in the tester copier to make 40,000 copies of a test image of a given pattern on A4-type recording papers, each of the tested photoconductors was measured for the thickness d1 (in μm) of the photosensitive layer with a thin film measurement system (F20-EXR; Filmetrics Japan Inc., Yokohama, Japan). The thickness d1 was subtracted from the thickness d0 at the time of production to obtain a difference Δd (i.e., d0-d1), a reduction of thickness, which was used as an index of printing durability.

(b) Electrical Properties and Environmental Stability

In order to measure the photoconductors for the surface potential during the image-forming process, a surface potentiometer (CATE751; GEN-TECH, INC., Yokohama, Japan) was provided in the tester copier. In the tester copier under the N/N environment (22° C., 65% of relative humidity), the photoconductor surface potential (V1 [in V]) was measured just after charging the surface by the charger, and the residual surface potential ($VL_N$ [in V]) was measured immediately after exposing the surface to laser light. The larger the absolute value of the surface potential V1 was, the superior in chargeability the photoconductor was considered. The smaller the absolute value of the residual potential $VL_N$ was, the superior in photoresponsiveness the photoconductor was considered.

The residual potential ($VL_L$ [in V]) under the L/L environment (5° C., 20% of relative humidity) was also measured as in the case for the residual potential $VL_N$ under the N/N environment. An absolute difference between the residual potentials under the L/L and N/N environment ($|VL_L-VL_N|$) was used as an index of potential variation ΔVL. The smaller the potential variation ΔVL was, the superior in stability of the electrical properties the photoconductor was considered.

The results for these evaluations are shown in Table 3.

TABLE 3

| | Charge-transporting material (Ex. Comp. No) | Charge-transporting material/ Binder resin | Reduction of Thickness Δd (μm) | Potential properties under N/N Environment $V_1$ (V) | $VL_N$ (V) | Potential variation under L/L Environment ΔVL (V) | Hole mobility ($cm^2/V\cdot sec$) $7.8\times10^{-4}$ |
|---|---|---|---|---|---|---|---|
| Example 5 | 1 | 10/20 | 2.1 | −543 | −35 | −28 | $8.5\times10^{-5}$ |
| Example 6 | 30 | 10/20 | 2.2 | −550 | −45 | −29 | $1.1\times10^{-4}$ |
| Example 7 | 45 | 10/20 | 2.1 | −545 | −38 | −25 | $1.8\times10^{-5}$ |
| Comparative Example 2 | A* | 10/20 | 4.5 | −535 | −110 | −80 | — |
| Example 8 | 1 | 10/25 | 1.7 | −548 | −43 | −30 | — |
| Example 9 | 30 | 10/25 | 1.7 | −551 | −58 | −32 | — |
| Example 10 | 45 | 10/25 | 1.8 | −545 | −48 | −30 | — |
| Reference Example 1 (Example 11) | 1 | 10/10 | 10.5 | −530 | −11 | −18 | — |
| Reference Example 2 | 1 | 10/31 | — | — | — | — | — |
| Reference Example 3 | A* | 10/10 | 12.3 | −518 | −15 | −28 | — |

Note:
A* indicates Comparative Compound A.

As seen from the comparison between Examples 5-7 and Comparative Example 2, the compounds represented by the general formula (1) according to the present invention have higher charge mobility than Compound A (TPD) by one to two or more orders of magnitude.

As seen from the comparison between Examples 5-10 and Comparative Example 2, the value $|VL_N|$ is smaller in Examples 5-10 than in Comparative Example 2. This means that the photoconductors of Examples 5-10 exhibit superior photoresponsiveness to the photoconductor of Comparative Example 2 even when the weight ratio of binder resin to charge-transporting material (B/A) in the charge transport layer is 1.2 or more. In addition, the potential variation ΔVL is smaller in Examples 5-10 than in Comparative Example 2, which means that the photoconductors of Examples 5-10 are superior in environmental stability to the photoconductor of Comparative Example 2. Therefore, the photoconductors of Examples 5-10 show sufficient photoresponsiveness under the L/L environment.

As seen from the comparison between Examples 5-10 and Example 11, the reduction of thickness Δd is smaller in Examples 5-10 than in Example 11. This means that the photoconductor with the ratio B/A ranging from 1.2 to 3.0 is superior in printing durability to the photoconductor with the ratio B/A being less than 1.2.

As seen from comparison of Example 11 with Comparative Example 2 and Reference Example 3, the printing durability of the photoconductor of Example 11 is superior to that of the photoconductor of Reference Example 3 whose B/A value equals to the value of the photoconductor of Example 11, although it is inferior to that of the photoconductor of Comparative Example 2 whose B/A value is higher than the value of the photoconductor of Example 11. The chargeability of the photoconductor of Example 11 is comparable with that of the photoconductor of Comparative Example 2.

As described above, the use of the compound of the present invention as a charge-transporting material in a photoconductor allows the photosensitive layer (in a single layer photoconductor) or the charge transport layer (in a multi-layer photoconductor) to be improved in printing durability without reducing the photoresponsiveness.

In conclusion,

The novel compounds represented by the general formula (1), in particular, compounds represented by formula (2) or (3), which have two enamine structures and two stilbene or butadiene structures which form extended conjugated systems in the molecules and have many hole hopping sites in their structure, exhibit high charge (or hole) transportability, and are therefore useful as an organic photoconductive material. In addition, the novel compounds have superior hard wearing properties.

The electrophotographic photoconductor comprising the compound as a charge-transporting material in its photosensitive layer exhibits high electric potential of charge, high sensitivity and sufficient photoresponsiveness. These good properties are not significantly deteriorated even when used under various environments such as low temperature environments or in a high-speed process. Therefore, the present electrophotographic photoconductor, and thus the image-forming apparatus using the same, are highly reliable. In addition, the present photoconductor can exhibit improved durability without significantly deteriorating the preferable properties.

What is claimed is:

1. An electrophotographic photoconductor comprising an electroconductive substrate and a photosensitive layer provided on the electroconductive substrate, wherein the photosensitive layer comprises a charge-generating material and a charge-transporting material, the charge-transporting material comprising a compound represented by the general formula (2):

(2)

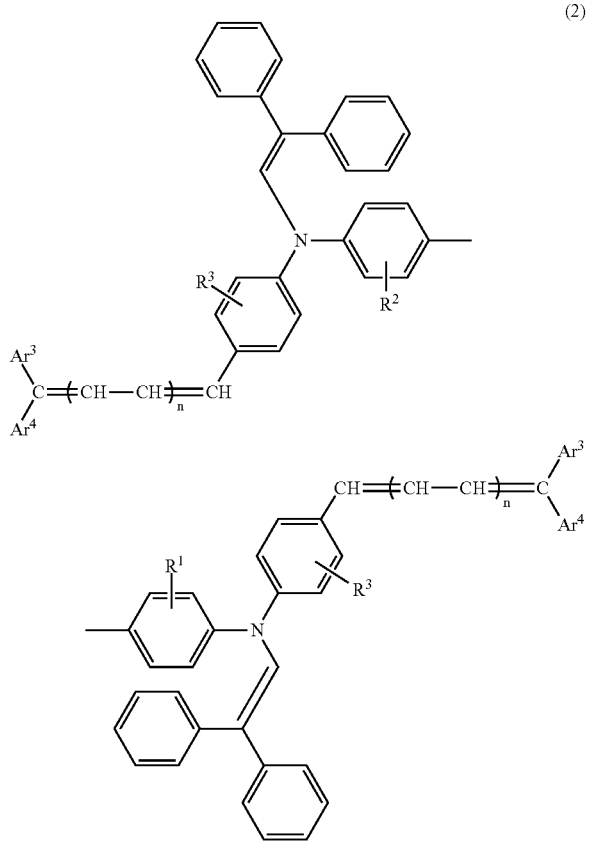

wherein $R^1$, $R^2$ and $R^3$ each independently represent a hydrogen atom, or an optionally-substituted alkyl or alkoxy group; and $Ar^3$ and $Ar^4$ each independently represent a hydrogen atom, or an optionally-substituted aryl or monovalent heterocyclic group, but are not simultaneously hydrogen atoms; or $Ar^3$ and $Ar^4$ may be taken together to form an optionally-substituted bivalent cyclic hydrocarbon or heterocyclic group; and n is 0 or 1.

2. An electrophotographic photoconductor comprising an electroconductive substrate and a photosensitive layer provided on the electroconductive substrate, wherein the photosensitive layer comprises a charge-generating material and a charge-transporting material, the charge-transporting material comprising a compound represented by the general formula (3):

(3)

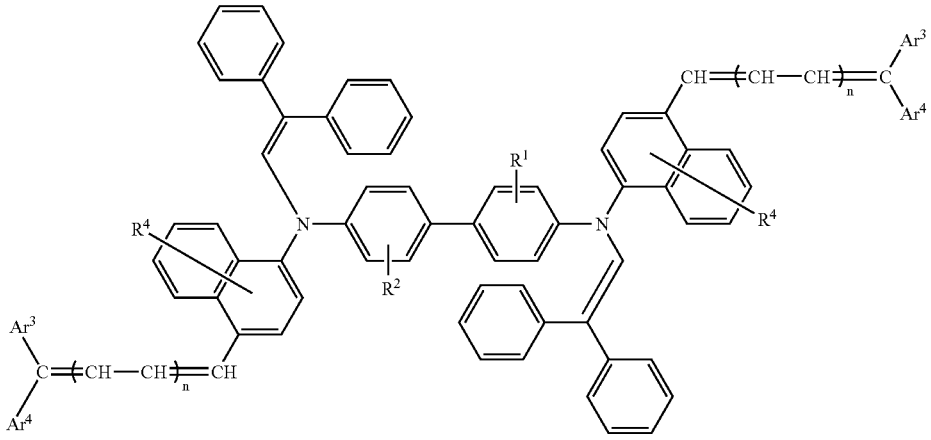

wherein $R^4$ represents a hydrogen atom, or an optionally-substituted alkyl or alkoxy group; $R^1$ and $R^2$ each independently represent a hydrogen atom, or an optionally-substituted alkyl or alkoxy group; and $Ar^3$ and $Ar^4$ each independently represent a hydrogen atom, or an optionally-substituted aryl or monovalent heterocyclic group, but are not simultaneously hydrogen atoms; or $Ar^3$ and $Ar^4$ may be taken together to form an optionally-substituted bivalent cyclic hydrocarbon or heterocyclic group; and n is 0 or 1.

3. The electrophotographic photoconductor according to claim 1, wherein the charge-generating material comprises oxotitanium phthalocyanine that presents at least a peak at the Bragg angle (2θ±0.2°) of 27.2° in the diffraction spectrum as observed with the Cu-Kα characteristic X-ray having a wavelength of 1.54 Å.

4. The electrophotographic photoconductor according to claim 1, wherein the photosensitive layer has a multi-layered structure which comprises a charge generation layer comprising the charge-generating material and a charge transport layer comprising the charge-transporting material.

5. The electrophotographic photoconductor according to claim 4, wherein the charge transport layer further comprises a binder resin, and a ratio by weight (NB) of the charge-transporting material (A) to the binder resin (B) in the charge transport layer ranges from 10/12 to 10/30.

6. The electrophotographic photoconductor according to claim 1, further comprising an interlayer between the electroconductive substrate and the photosensitive layer.

7. An image-forming apparatus comprising the electrophotographic photoconductor according to claim 1.

8. The electrophotographic photoconductor according to claim 2, wherein the charge-generating material comprises oxotitanium phthalocyanine that presents at least a peak at the Bragg angle (2θ±0.2°) of 27.2° in the diffraction spectrum as observed with the Cu-Kα characteristic X-ray having a wavelength of 1.54 Å.

9. The electrophotographic photoconductor according to claim 2, wherein the photosensitive layer has a multi-layered structure which comprises a charge generation layer comprising the charge-generating material and a charge transport layer comprising the charge-transporting material.

10. The electrophotographic photoconductor according to claim 9, wherein the charge transport layer further comprises a binder resin, and a ratio by weight (NB) of the charge-transporting material (A) to the binder resin (B) in the charge transport layer ranges from 10/12 to 10/30.

11. The electrophotographic photoconductor according to claim 2, further comprising an interlayer between the electroconductive substrate and the photosensitive layer.

12. An image-forming apparatus comprising the electrophotographic photoconductor according to claim 2.

* * * * *